US009046869B2

(12) United States Patent
Itabashi et al.

(10) Patent No.: US 9,046,869 B2
(45) Date of Patent: Jun. 2, 2015

(54) CARTRIDGES INCLUDING DETECTION MEMBER AND COVER MEMBER

(71) Applicants: Nao Itabashi, Nagoya (JP); Naoya Kamimura, Ichinomiya (JP)

(72) Inventors: Nao Itabashi, Nagoya (JP); Naoya Kamimura, Ichinomiya (JP)

(73) Assignee: Brother Kogyo Kabushiki Kaisha, Nagoya-shi, Aichi-ken ( * ) Notice: Subject to any disclaimer, the term of this patent is extended or adjusted under 35 U.S.C. 154(b) by 0 days.

(21) Appl. No.: 14/032,259

(22) Filed: Sep. 20, 2013

(65) Prior Publication Data

US 2014/0086613 A1 Mar. 27, 2014

(30) Foreign Application Priority Data

Sep. 21, 2012 (JP) ..... 2012-208910

(51) Int. Cl.
*G03G 21/16* (2006.01)
*G03G 21/18* (2006.01)
*G03G 15/08* (2006.01)

(52) U.S. Cl.
CPC ..... *G03G 21/1604* (2013.01); *G03G 15/0863* (2013.01); *G03G 21/1867* (2013.01); *G03G 21/1896* (2013.01)

(58) Field of Classification Search
CPC ..... G03G 21/1867; G03G 21/1604; G03G 21/1896
USPC ..... 399/12, 13, 90
See application file for complete search history.

(56) References Cited

U.S. PATENT DOCUMENTS

| | | | | |
|---|---|---|---|---|
| 7,978,997 | B2 * | 7/2011 | Tokuda | 399/90 |
| 8,843,014 | B2 * | 9/2014 | Itabashi et al. | 399/90 |
| 2006/0193646 | A1 | 8/2006 | Suzuki et al. | |

FOREIGN PATENT DOCUMENTS

JP 2006-267994 A 10/2006

* cited by examiner

*Primary Examiner* — Sandra Brase
(74) *Attorney, Agent, or Firm* — Baker Botts L.L.P.

(57) ABSTRACT

Cartridges may include a developing roller, an electrode, a detection member, and a cover member. The developing roller rotates about an axis extending along a first direction. The electrode includes a protrusion that protrudes along the first direction to an end portion. The detection member includes a cover portion, which covers an exposable portion of the protrusion when the detection member is in a first position, and which exposes the exposable portion of the protrusion when the detection member is in a second position. The cover member covers a portion of the detection member and exposes the cover portion when the detection member is in the first position. The cover member extends in the first direction to an end portion. An overlap portion of the protrusion extends at least to the end portion of the cover member and overlaps a portion of the cover member in a second direction.

28 Claims, 23 Drawing Sheets

CARTRIDGES INCLUDING DETECTION MEMBER AND COVER MEMBER

CROSS-REFERENCE TO RELATED APPLICATIONS

This application claims priority from Japanese Patent Application No. 2012-208910, filed on Sep. 21, 2012, which is incorporated herein by reference.

BACKGROUND OF THE DISCLOSURE

1. Field of the Disclosure

The present disclosure relates generally to developing cartridges and, more specifically, to cartridges including a detection member and a cover member.

2. Description of the Related Art

Xerographic printers comprising a photosensitive member and a developing cartridge for supplying developer to the photosensitive member are known.

Such known printers include a detector for detecting information about the attached developing cartridge (e.g., whether the developing cartridge is new).

For example, a laser printer (e.g., a kind of xerographic printer) including a developing cartridge and a main body has been proposed. The main body of the laser printer includes a detector that includes an actuator and a light sensor, and the developing cartridge includes an abutting protrusion. When the developing cartridge is attached to the main body, the abutting protrusion is driven by the driving force supplied from the main body, moves, and contacts the actuator. When the abutting protrusion of the developing cartridge contacts the actuator of the main body, the actuator moves and the tight sensor senses the movement of the actuator. The detector detects the information about the developing cartridge based on information sensed by the light sensor.

SUMMARY OF THE DISCLOSURE

Accordingly, it is an object of the present invention to provide a cartridge that may make the detection of the information of the cartridge easier.

Cartridges disclosed herein may include a developing roller, an electrode, a detection member, and a cover member. The developing roller may rotate about a first axis extending along a first direction. The electrode may electrically connect to the developing roller. The electrode may include a main body and a protrusion. The protrusion may protrude along the first direction from the main body to an end portion of the protrusion. The detection member may be rotatably supported on the protrusion. The detection member may include a cover portion, which may cover an exposable portion of the protrusion when the detection member is in a first rotational position. Moreover, the cover portion may expose the exposable portion of the protrusion when the detection member is in a second rotational position. The cover member may cover a portion of the detection member. Further, the cover member may form an opening therein, which may expose the cover portion of the detection member when the detection member is in the first rotational position. Moreover, the cover member may extend along the first direction to an end portion of the cover member. An overlap portion of the end portion of the protrusion may extend at least to the end portion of the cover member. Consequently, the overlap portion may overlap a portion of the end portion of the cover member in a second direction that is perpendicular to the first direction.

Cartridges disclosed herein may include a developing roller, an electrode, a detection member, and a cover member. The developing roller may rotate about a first axis extending along a first direction. The electrode may electrically connect to the developing roller. The electrode may include a main body and a protrusion. The protrusion may protrude along the first direction from the main body to an end portion of the protrusion. The detection member may be rotatably supported on the protrusion. The detection member may include a cover portion, which may cover a portion of the protrusion, and which may expose another portion of the protrusion. The cover member may form an opening, which may expose the cover portion of the detection member. Further, the cover member may cover another portion of the detection member. Moreover, the cover member may extend along the first direction to an end portion of the cover member. An overlap portion of the end portion of the protrusion may extend at least to the end portion of the cover member. Consequently, the overlap portion may overlap a portion of the end portion of the cover member in a second direction that is perpendicular to the first direction.

Cartridges disclosed herein may include a developing roller, an electrode, a detection member, and a cover member. The developing roller may rotate about a first axis extending along a first direction. The electrode may electrically connect to the developing roller. The electrode may include a main body and a protrusion. The protrusion may protrude along the first direction from the main body to an end portion of the protrusion. The detection member may be rotatably supported on the protrusion. The detection member may include a cover portion, which may cover a portion of the protrusion, and which may expose another portion of the protrusion. The cover member may form an opening, which may expose the other portion of the detection member. Further, the cover member may cover at least a portion of the cover portion. Moreover, the cover member may extend along the first direction to an end portion of the cover member. An overlap portion of the end portion of the protrusion may extend at least to the end portion of the cover member. Consequently, the overlap portion may overlap a portion of the end portion of the cover member in a second direction that is perpendicular to the first direction.

Other objects, features, and advantages will be apparent to persons of ordinary skill the art from the following detailed description of the disclosure and the accompanying drawings.

BRIEF DESCRIPTION OF THE DRAWINGS

For a more complete understanding of the present disclosure, needs satisfied thereby, and the objects, features, and advantages thereof, reference now is made to the following descriptions taken in connection with the accompanying drawings.

FIG. 5A is a diagram showing a perspective view of the cartridge detection gear; and FIG. 5B is a diagram showing another perspective view of the cartridge detection gear.

FIG. 7A is a diagram showing a perspective view of the developing cartridge; and FIG. 7B is a cross-sectional diagram of the developing cartridge along the line A-A shown in FIG. 7A.

DETAILED DESCRIPTION OF EMBODIMENTS OF THE INVENTION

Figure 1:
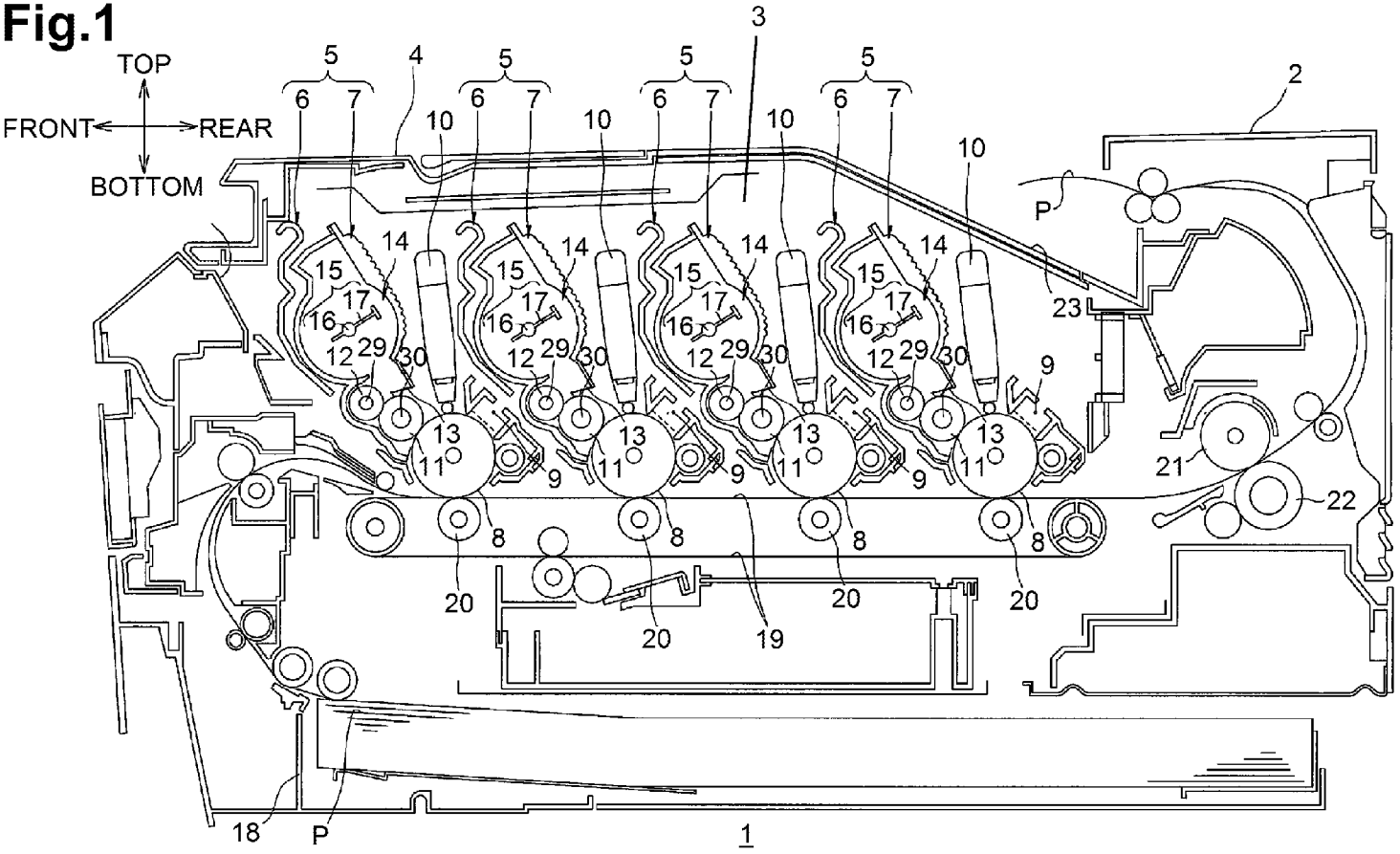
FIG. 1 is a central cross-sectional diagram showing the printer to which the developing cartridge is attached.

As shown in FIG. 1, a printer 1 may be a tandem type of color printer. Further, the direction of printer 1 used herein utilizes a vertical reference defined as the vertical direction when the printer 1 lies in the right-left direction. Thus, the upper side of the plane of paper showing FIG. 1 may be referred to as the upper side, and the lower side of the plane of paper showing FIG. 1 may be referred to as the lower side. In addition, the left side of the plane of paper showing FIG. 1 may be referred to as the front side, and the right side of the plane of paper showing FIG. 1 may be referred to as the back side. Moreover, the right-left reference directions are defined as the right and left directions when facing the printer 1 from the front side with the upper side positioned above the lower side. Thus, the near side of the plane of paper showing FIG. 1 may be referred to as the right side, and the far side of the plane of paper depicting FIG. 1 may be referred to as the left side. Further, the right-left direction may refer to either or both of the right direction and the left direction (e.g., into or out of the page in FIG. 1).

The printer 1 may comprise a casing 2 with substantially box shape. The casing 2 may form an opening 3 therein. The printer 1 may comprise a cover 4 that may be pivotally supported at an upper end portion of the casing 2. The cover 4 may be configured to open and close the opening 3 of the casing 2. The printer 1 may comprise a plurality (e.g., four) of process cartridges 5.

Each of the process cartridges 5 may be detachably mounted in the casing 2 in a parallel arrangement separated from each other. Further, each of the plurality of process cartridges 5 may correspond to one color of multiple (e.g., four) colors (e.g., black, yellow, magenta, and cyan).

Each of the process cartridges 5 may comprise a drum cartridge 6 and a developing cartridge 7 detachably mounted to the drum cartridge 6.

The drum cartridge 6 may comprise a photosensitive drum 8 and a scorotron charger 9.

The photosensitive drum 8 may form a substantially cylindrical shape elongated in the right-left direction and may be rotatably supported at the rear end portion of the drum cartridge 6.

The scorotron charger 9 may face the upper-rear side of the photosensitive drum 8.

The developing cartridge 7 may comprise a developing roller 11 and a supply roller 12 that may be configured to supply toner to the developing roller 11.

The developing roller 11 may be exposed from the rear side of the rear end of the developing cartridge 7 so that contact may be made with the photosensitive drum 8 from the upper-front side. The developing roller 11 may form a substantially cylindrical shape extending in the right-left direction. The developing roller 11 may comprise a metal-based rotating shaft (e.g., a developing roller shaft 30) extending in the right-left direction along an axis of rotation A1 thereof. The right and left ends of the developing roller shaft 30 may be rotatably supported by two side walls 34 (described below) of a cartridge frame 31 (described below).

The supply roller 12 may be disposed at the upper-front side of the developing roller 11 so as to make contact with the developing roller 11. The supply roller 12 may form a substantially cylindrical shape extending in the right-left direction. The supply roller 12 may comprise a metal-based rotating shaft (e.g., a supply roller shaft 29) extending in the right-left direction along an axis of rotation thereof. The right and left ends of the supply roller shaft 29 may be rotatably supported by the two side walls 34 (described below) of the cartridge frame 31 (described below).

Further, the developing cartridge 7 may comprise a layer thickness regulating blade 13 that may be configured to regulate the thickness of the toner supplied on the developing roller 11. In addition, the developing cartridge 7 may comprise a toner storage portion 14 that may be disposed on the upper side of the developing roller 11 and the supply roller 12 and may be configured to store the toner.

The toner storage portion 14 may comprise an agitator 15 that may be configured to agitate the toner.

Figure 3:
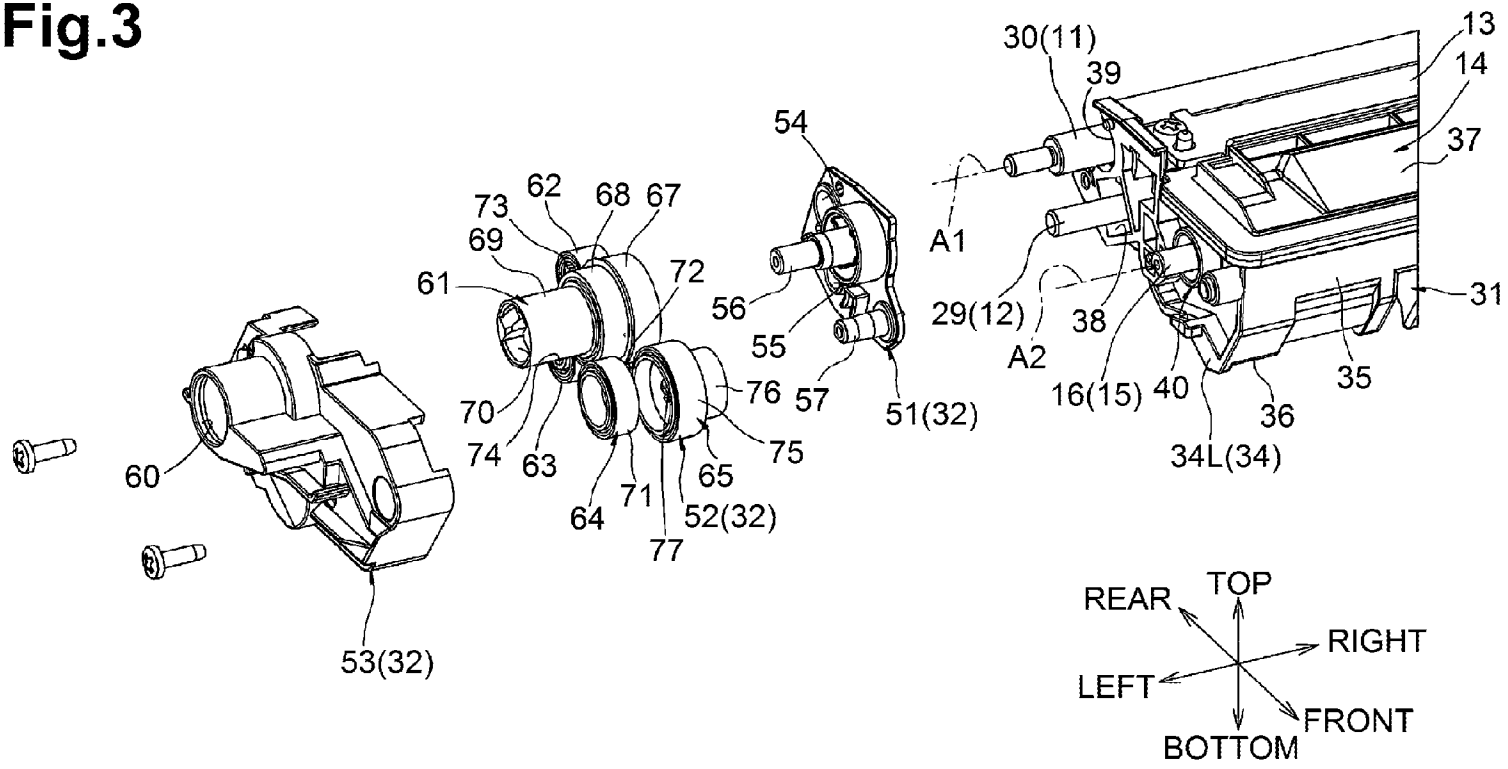
FIG. 3 is a diagram showing an exploded perspective view of a left end of the developing cartridge shown in FIG. 2.

The agitator 15 may comprise an agitator shaft 16 extending in the right-left direction and an agitator vane 17 extending from the agitator shaft 16 toward the interior circumference of the toner storage portion 14, which may rotate around an axis of rotation A2 of the agitator shaft 16 (FIG. 3 provides an example of a second axis of rotation).

The toner in the toner storage portion 14 may be frictionally charged with a positive charge between the supply roller 12 and the developing roller 11, and may be supported on the surface of the developing roller 11 by the layer thickness regulating blade 13 as a thin layer with a substantially uniform thickness.

In contrast, the surface of the photosensitive drum 8 may be uniformly charged by the scorotron charger 9 and subsequently exposed according to the predetermined image data by an light-emitting diode ("LED") device 10 facing the upper side of the photosensitive drum 8. Consequently, an electrostatic latent image may be formed on the surface of the photosensitive drum 8, based on the image data. Moreover, the toner supported on the developing roller 11 may be supplied onto the electrostatic latent image on the surface of the photosensitive drum 8, and the toner image (e.g., developer image) may be supported on the surface of the photosensitive drum 8.

A paper P may be stored in a paper feed tray 18 provided in the bottom of the casing 2, transported by each roller toward the upper-rear side in a U-turn type of pattern, and subsequently fed between the photosensitive drum 8 and a transport belt 19, one sheet at a time. Further, the paper P may be transported by the transport belt 19 between the photosensitive drums 8 and transfer rollers 20 from the front side to the rear side. At this time, the toner image may be transferred to the paper P.

In addition, the paper P may be heated and pressurized when passing between a heating roller 21 and a pressurizing roller 22. At this time, the toner image may be heat-fused to the paper P.

Thereafter, the paper P may be transported to the upper-front side in a U-turn type of pattern and discharged to a discharge tray 23 provided in or around the top cover 4.

Figure 2:
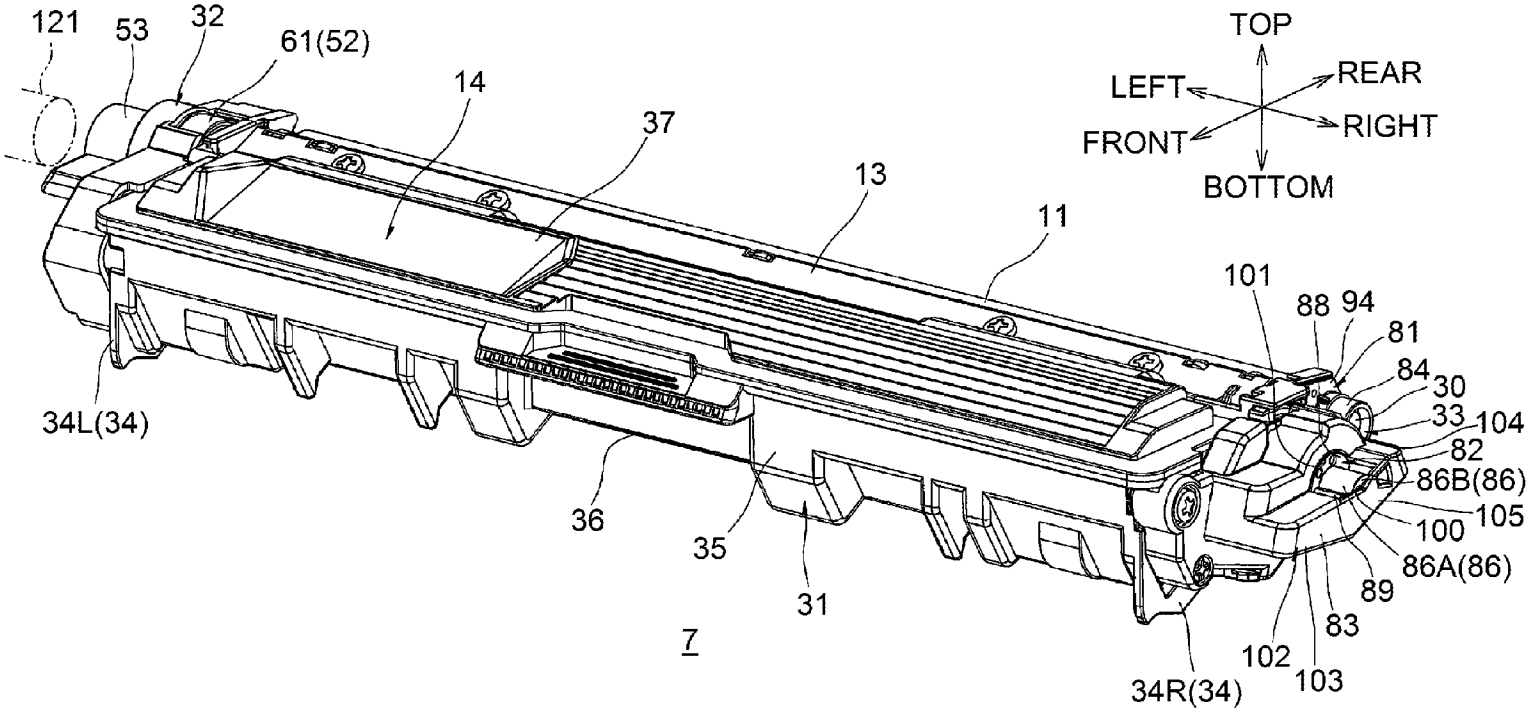
FIG. 2 is a diagram showing a perspective view of the developing cartridge shown in FIG. 1.

As shown in FIG. 2, the developing cartridge 7 may comprise a cartridge frame 31, a drive device 32 that may be arranged at the left side of the cartridge frame 31, and a power supply device 33 that may be arranged at the right side of the cartridge frame 31.

Further, when referring to directions with regards to the following description of the developing cartridge 7, the side where the developing roller 11 is arranged is referred to as the rear side of the developing cartridge 7, and the side where the layer thickness regulating blade 13 is arranged is referred to as the upper side. Consequently, the vertical and front-rear directions related to the developing cartridge 7 may be different from the vertical and front-rear directions of the printer 1, and the developing cartridge 7 may be attached in the printer 1, such that the front of the developing cartridge 7 is the upper-front side of the printer 1, the rear thereof is the lower-rear side of the printer 1, the top side thereof is the upper-rear side of the printer 1, and the bottom thereof is the lower-front side of the printer 1.

Figure 4:
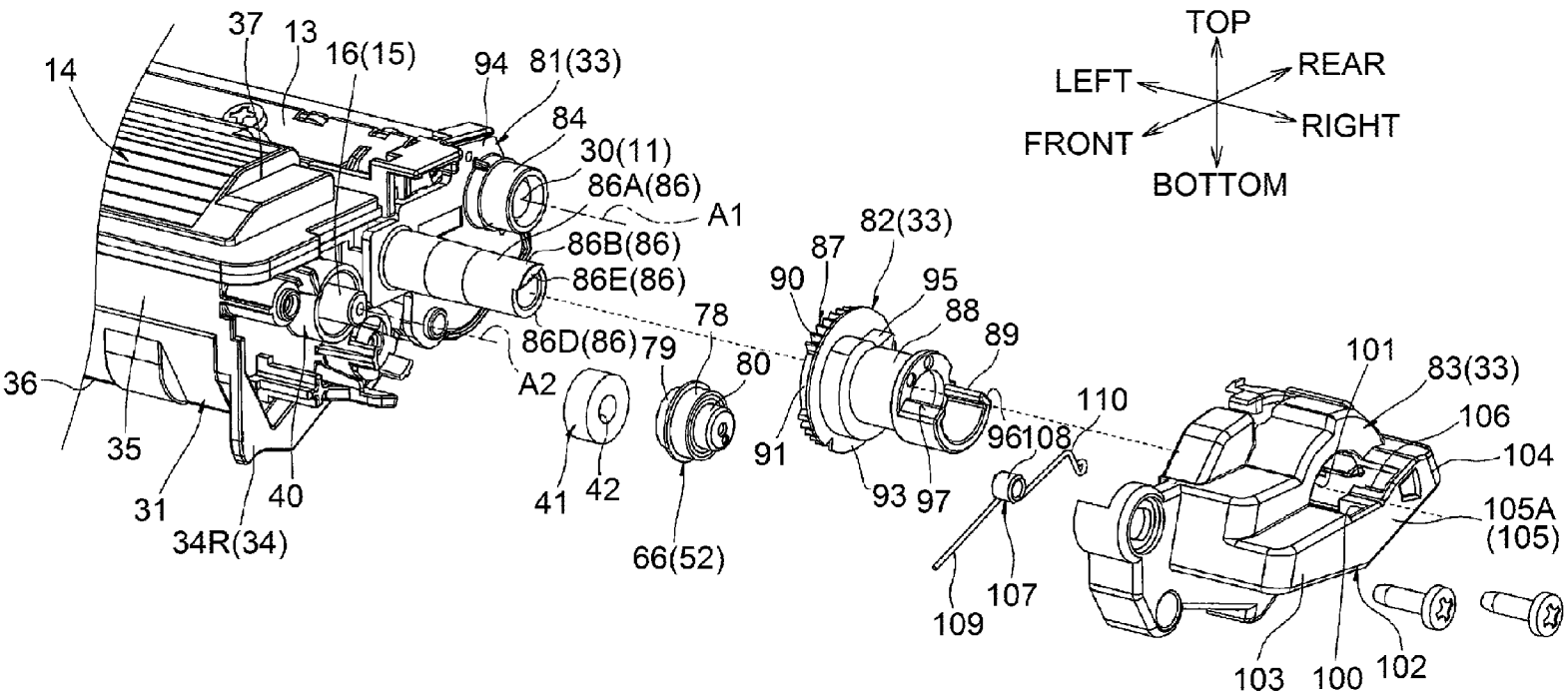
FIG. 4 is a diagram showing an exploded perspective view of a right end of the developing cartridge shown in FIG. 2.

The cartridge frame 31 may form a substantially box shape extending in the right-left direction. As shown in FIG. 3 and FIG. 4, the cartridge frame 31 may comprise a pair of left and right side walls 34, a front wall 35, a lower wall 36, and an upper wall 37. Further, in the following description the left wall of the side walls 34 may be a left wall 34L, and the right wall of the side walls 34 may be a right wall 34R.

Each of the pair of side walls 34 may form a substantially rectangular shape from the side view and may face each other in the right-left direction. Further, each of the side walls 34 may forma developing roller shaft exposure hole 39 and a supply roller shaft exposure hole 38 and may comprise an agitator shaft supporting portion 40.

The developing roller shaft exposure hole 39 may be formed as a through-hole forming a substantially U-shaped shape from the side view that may open toward the upper-rear side at the upper-rear end of each of the side walls 34. The vertical length of the developing roller shaft exposure hole 39 may be longer than the diameter of the right and left end portions of the developing roller shaft 30. In addition, the right and left ends of the developing roller shaft 30 may be exposed from the side walls 34 toward the outside of the cartridge frame 31 through the developing roller shaft exposure hole 39.

The supply roller shaft exposure hole 38 may be a through-hole forming a substantially rectangular shape from the side view at the lower-front side of the developing roller shaft exposure hole 39. The length of each edge of the supply roller shaft exposure hole 38 may be longer than the diameter of both the right and left ends of the supply roller shaft 29. Further, the right and left ends of the supply mile shaft 29 may be exposed from the side walls 34 toward outside of the cartridge frame 31 through the supply roller shaft exposure hole 38.

The agitator shaft supporting portion 40 may be formed at the upper-front side of the supply roller shaft exposure hole 38 and may form a substantially circular shape extending in the right-left direction so as to penetrate the side walls 34. The inner diameter of the agitator shaft supporting portion 40 may be formed with a diameter larger than the diameter of both the right and left end portions of the agitator shaft 16. Further, the right and left ends of the agitator shaft 16 may be exposed from the side walls 34 toward outside of the cartridge frame 31 through the agitator shaft supporting portion 40. A seal member 41 (as shown in FIG. 4) may be fitted inside the agitator shaft supporting portion 40.

The seal member 41 may form a substantially cylindrical shape extending in the right-left direction and may comprise materials with elastic properties, such as a sponge. The outer diameter of the seal member 41 may be larger than the inner diameter of the agitator shaft supporting portion 40. Further, an agitator shaft insertion hole 42 may be formed through the radial center of the seal member 41.

The agitator shaft insertion hole 42 may form a substantially cylindrical shape from the side view with a diameter smaller than the outer diameter of the agitator shaft 16.

Further, the seal member 41 may be fitted to left side of agitator shaft 16 and, at the same time, may press into the interior of the agitator shaft supporting portion 40.

Figure 6:
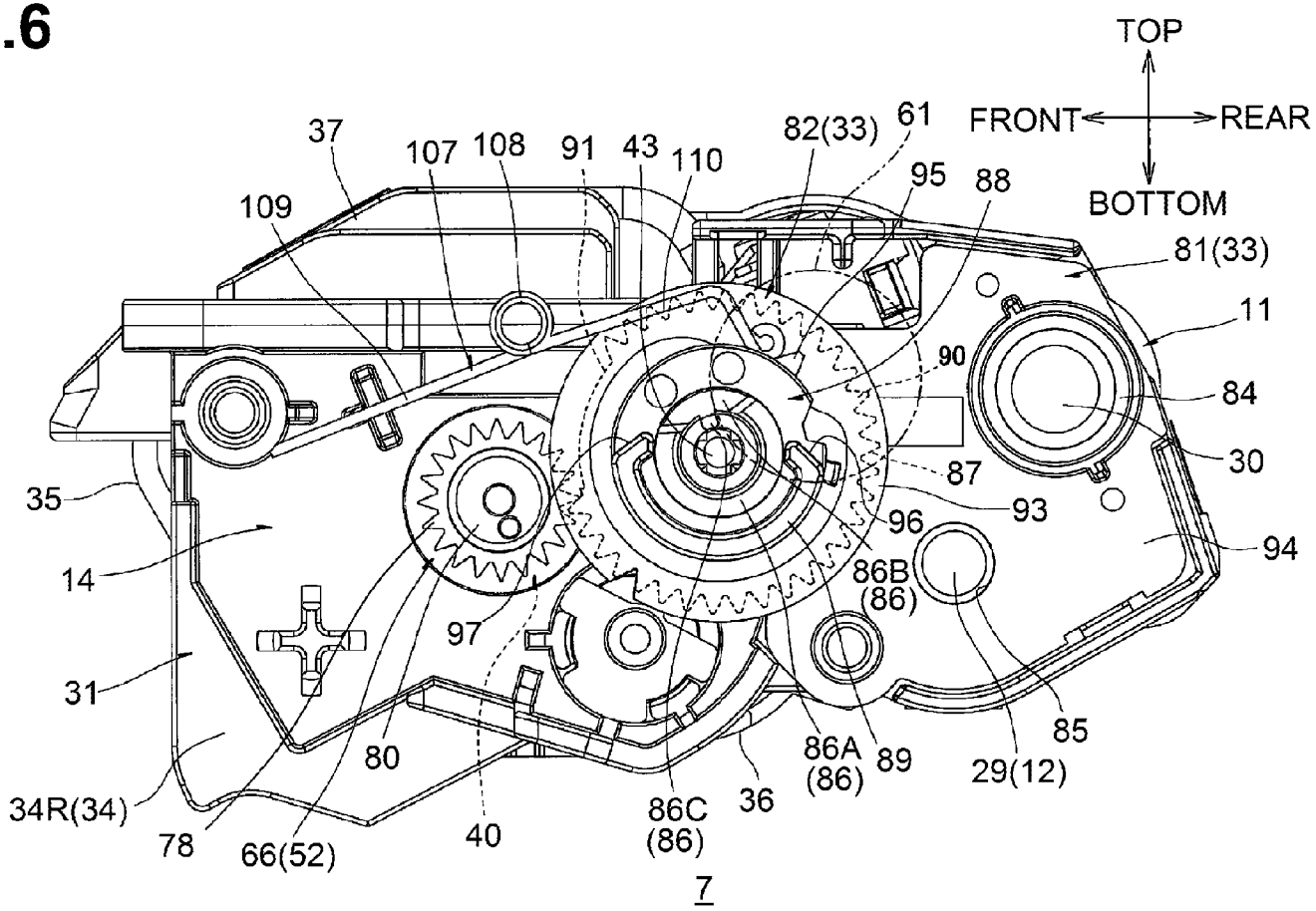
FIG. 6 is a diagram showing a right side view of the developing cartridge shown in FIG. 2. A cover is omitted from FIG. 6.

In addition, as shown in FIG. 6, a fitting protrusion 43 may be provided at the right wall 34R.

The fitting protrusion 43 may form a substantially cylindrical shape protruding from the right surface of the right wall 34R in the right direction at the right-rear side of the agitator shaft supporting portion 40.

The front wall 35 may be erected between front ends of the side walls 34. The front wall 35 may form a substantially plate shape and may extend vertically (e.g., in the top-bottom direction) and in the right-left direction (e.g., into and out-of the paper in FIG. 6).

The lower wall 36 may be erected in between the bottom ends of the side walls 34 and may connect to the lower end of the front wall 35. The lower wall 36 may form a substantially plate shape and may extend in the front-rear direction and in the right-left direction.

The upper wall 37 may face an upper side of the front wall 35 and an upper side of each of the side walls 34. The upper wall 37 may form a substantially plate shape extending in the front-rear direction and in the right-left direction. The edges of the upper wall 37 may be welded to the side walls 34 and the upper end of the front wall 35 at the periphery edges thereof.

As shown in FIG. 3, the drive device 32 may comprise a bearing member 51, a gear array 52, and a drive side cover 53.

The bearing member 51 may form a plate shape that may be a substantially rectangular shape in the side view. The bearing member 51 may form a developing roller shaft supporting hole 54 and a supply roller shaft supporting hole 55. The bearing member 51 may comprise a coupling supporting shaft 56 and an idle gear supporting shaft 57.

The developing roller shaft supporting hole 54 may be formed as a through-hole with a substantially circular shape in the side view from the upper end portion of the bearing member 51. The inner diameter of the developing roller shaft supporting hole 54 may be formed as a diameter substantially the same size as or slightly larger than the outer diameter of the developing roller shaft 30.

The supply roller shaft supporting hole 55 may be formed as a through-hole with a substantially circular shape from the side view from the lower-front side of the developing roller shaft supporting hole 54. The inner diameter of the supply roller shaft supporting hole 55 may be formed as a diameter substantially the same size as or slightly larger than the outer diameter of the supply roller shaft 29.

The coupling supporting shaft 56 may form a substantially cylindrical shape protruding from the left surface of the bearing member 51 toward the left side from the front side of the developing roller shaft supporting hole 54 and at the upper-front side of the supply roller shaft supporting hole 55.

The idle gear supporting shaft 57 may form a substantially circular shape protruding from the left surface of the bearing member 51 toward the left side from the front end portion of the bearing member 51.

The gear array 52 may comprise a coupling 61, a developing gear 62, a supply gear 63, an idle gear 64, a first agitator gear 65, and a second agitator gear 66 (shown in FIG. 4).

The coupling 61 may form a substantially cylindrical shape extending in the right-left direction. Further, the radial central portion of the coupling 61 may form a fitting hole with a diameter larger than or substantially the same as the outer diameter of the coupling supporting shaft 56. The coupling 61 may comprise a large diameter gear portion 67, a small diameter gear portion 68, and a coupling portion 69.

The large diameter gear portion 67 may be provided to the right end portion of the coupling 61. The large diameter gear portion 67 may form a substantially disc shape with a thickness in the right-left direction. Gear teeth may be formed around the entire circumference of the large diameter gear portion 67.

The small diameter gear portion 68 may form a substantially cylindrical shape protruding from the left surface of the large diameter gear portion 67 in the left direction. The outer diameter of the small diameter gear portion 68 may be smaller than the outer diameter of the large diameter gear portion 67. The rotational axis of the small diameter gear portion 68 may line up with rotational axis of the large diameter gear portion 67. Gear teeth may be formed around the entire circumference of the small diameter gear portion 68.

The coupling portion 69 may form a substantially cylindrical shape protruding from the left surface of the small diameter gear 68 in the left direction. The outer diameter of the coupling portion 69 may be smaller than the outer diameter of the small diameter gear portion 68. The rotational axis of the coupling portion 69 may line up with the rotational axis of the small diameter gear portion 68. A connecting depression 70 may be formed at the left surface of the coupling portion 69.

The connecting depression 70 may form a substantially elongated hole shape in the side view that extends radially to the coupling 61 so as to depress from the left surface of the coupling portion 69 in the right direction.

The developing gear 62 may form a substantially disc shape with a thickness in the right-left direction. A developing roller shaft fitting hole 73 may be formed at the radial center portion of the developing gear 62 so as to receive the left end portion of the developing roller shaft 30. Gear teeth may be formed around the entire circumference of the developing gear 62.

The supply gear 63 may form a substantially disc shape with a thickness in the right-left direction. A supply roller shaft fitting hole 74 may be formed at the radial center portion of the supply gear 63 so as to receive the left end of the supply roller shaft 29. Gear teeth may be formed around the entire circumference of the supply gear 63.

The idle gear 64 may form a substantially cylindrical shape extending in the right-left direction. The idle gear 64 may comprise a large diameter portion 71 and a small diameter portion 72 in an integrated manner.

The large diameter portion 71 may be provided at the left end portion of the idle gear 64 and may form a substantially disc shape with a thickness in the right-left direction. The outer diameter of the large diameter portion 71 may be smaller than the outer diameter of the small diameter gear portion 68 at the coupling portion 69. Gear teeth may be formed around the entire circumference of the large diameter portion 71.

The small diameter portion 72 may form a substantially cylindrical shape extending in the right-left direction so as to protrude from the right surface of the large diameter portion 71 in the right direction. The outer diameter of the small diameter portion 72 may be smaller than the outer diameter of the large diameter portion 71. The small diameter portion 72 may share the same axis of rotation with the large diameter portion 71. A fitting hole (not shown) may be formed in the radial center of the small diameter portion 72 as a through-hole that may receive the idle gear supporting shaft 57. Gear teeth may be formed around the entire circumference of the small diameter portion 72.

The first agitator gear 65 may form a substantially cylindrical shape extending in the right-left direction. The first agitator gear 65 may comprise a gear portion 75 and a fitting cylinder portion 76.

The gear portion 75 may form a substantially disc shape with a thickness in the right-left direction at the left end of the first agitator gear 65. Gear teeth may be formed around the entire circumference of the gear portion 75. An agitator shaft fitting hole 77 may be formed in the radial center of the gear portion 75 as a through-hole that may receive the left end of the agitator shaft 16.

The fitting cylinder portion 76 may form a substantially cylindrical shape extending in the right-left direction so as to protrude from the right surface of the gear portion 75 in the right direction. The fitting cylinder portion 76 may share the same axis of rotation with the gear portion 75. The inner diameter of the fitting cylinder portion 76 may be substantially the same size as or slightly larger than the diameter of the outer diameter of the agitator shaft supporting portion 40.

As shown in FIG. 4, the second agitator gear 66 may form a substantially cylindrical shape extending in the right-left direction. The second agitator gear 66 may comprise a gear portion 78, a fitting cylinder portion 79, and a collar portion 80.

The gear portion 78 may form a substantially disc shape with a thickness in the right-left direction in a substantially center portion of the second agitator gear 66 along the right-left direction. Fewer gear teeth than those in the gear portion 75 of the first agitator gear 65 may be formed around the entire circumference the gear portion 78. A fitting hole (not shown) may be formed at the radial center portion of the gear portion 78 as a through-hole to receive the right end of the agitator shaft 16.

The fitting cylinder portion 79 may form a substantially cylindrical shape extending in the right-left direction so as to protrude from the left surface of the gear portion 78 in the right direction. The fitting cylinder portion 79 may share the same axis of rotation with the gear portion 78. The outer diameter of the fitting cylinder portion 79 may be substantially the same size as or slightly smaller than the inner diameter of the agitator shaft supporting portion 40.

The collar portion 80 may form a substantially cylindrical shape extending in the right-left direction with the right end portion closed so as to protrude from the right surface of the gear portion 78 in the right direction.

As shown in FIG. 3, the drive side cover 53 may form a substantially tubular shape extending in the right-left direction with the left end closed. A collective size of the coupling 61, the supply gear 63, the idle gear 64, and the first agitator gear 65 together may be a coverable size (e.g., in the front-rear direction and the vertical direction), over which the drive side cover 53 may fit to cover the coupling 61, the supply gear 63, the idle gear 64, and the first agitator gear 65 together. Further, a coupling exposure opening 60 may be formed in the drive side cover 53.

The coupling exposure opening 60 may be formed as a through-hole with a substantially circular shape in the side view at the left wall in substantially the front-rear center portion of the drive side cover 53 so as to expose the left surface of the coupling portion 69 of the coupling 61.

The bearing member 51 may be installed to the left surface of the side wall 34L so that the left end portion of the developing roller shaft 30 may be inserted into the developing roller shaft supporting hole 54 to enable rotation, and, at the same time, the left end of the supply roller shaft 29 may be inserted into the supply roller shaft supporting hole 55 to enable rotation.

This configuration may enable the left end portion of the developing roller shaft 30 to be supported in the developing roller shaft supporting hole 54 so as to rotate. Further, the left end portion of the supply roller shaft 29 may be supported in the supply roller shaft supporting hole 55 to enable rotation therebetween.

The coupling 61 may be supported in the coupling supporting shaft 56 of the bearing member 51 so as to enable relative rotation.

The developing gear 62 may be supported in the left end of the developing roller shaft 30, such that relative rotation therebetween is prevented and the developing roller shaft 30 may be inserted into the developing roller shaft fitting hole 73. The developing gear 62 may engage with the large diameter gear portion 67 in the coupling 61 from the rear.

The supply gear 63 may be supported on the left end portion of the supply roller shaft 29, such that relative rotation therebetween is prevented and the supply roller shaft 29 may be inserted into the supply roller shaft fitting hole 74. The supply gear 63 may engage with the small diameter gear portion 68 of the coupling 61 from the lower-rear.

The idle gear 64 may be supported on the idle gear supporting shaft 57 of the bearing member 51 to enable relative rotation therebetween. The large diameter portion 71 of the idle gear 64 may engage with the small diameter gear portion 68 of the coupling 61 from the lower front side. Further, the small diameter portion 72 of the idle gear 64 may face the tower-front side of the large diameter gear portion 67 of the coupling 61 separated by a space.

The first agitator gear 65 may be installed on the left end of the agitator shaft 16, such that relative rotation therebetween is prevented, and, at the same time, the fitting cylinder portion 76 thereof may be fitted to the agitator shaft supporting portion 40 to enable rotation. Thus, the first agitator gear 65 may rotate around the rotational axis A1 of the agitator shaft 16. The gear portion 75 in the first agitator gear 65 may engage with the small diameter portion 72 in the idle gear 64 from the front.

Further, the drive side cover 53 may permit exposure of the left surface of the coupling portion 69 of the coupling 61 through the coupling exposure opening 60, and, at the same time, the coupling 61 (excluding the left surface of the coupling portion 69), the supply gear 63, the idle gear 64, and the first agitator gear 65 may be screwed into the left wall 34L so as to be collectively covered.

In addition, as shown in FIG. 4, the second agitator gear 66 may be installed to the right end portion of the agitator shaft 16, such that relative rotation therebetween is prevented, and, at the same time, the fitting cylinder portion 76 thereof may be fitted to the agitator shaft, supporting portion 40 to enable rotation. Thus, the second agitator gear 66 may rotate around the axis of rotation A1 of the agitator shaft 16.

As shown in FIG. 4 and FIG. 6, the power supply device 33 may comprise an electrode member 81, a new cartridge detection gear 82, and a cover 83.

The electrode member 81 may be formed from plastic materials with electroconductive properties (e.g., conducting polymer materials, such as polyacetal plastic). The electrode member 81 may comprise a casing 94, a developing roller shaft supporting portion 84, a supply roller shaft supporting portion 85 (shown in FIG. 6), and a power receiving portion 86.

The casing 94 may form a plate shape that may be substantially rectangular from the side view.

The developing roller shaft supporting portion 84 may form a substantially cylindrical shape extending in the right-left direction at the upper-rear end of the casing 94 so as to penetrate the casing 94. The inner diameter of the developing roller shaft supporting portion 84 may be formed to be substantially the same size as or slightly larger than the outer diameter of the right end of the developing roller shaft 30.

The supply roller shaft supporting portion 85 may form a substantially circular shape in the side view at the lower-front side of the developing roller shaft supporting portion 84 so as to penetrate the casing 94. The inner diameter of the supply roller shaft supporting portion 85 may be formed to be substantially the same size as or slightly larger than the outer diameter of the supply roller shaft 79.

The power receiving portion 86 may be disposed at the upper-front side of the supply roller shaft supporting portion 85. The power receiving portion 86 may comprise a main body 86A, an extending portion 86B, and a rib 86C.

The main body 86A may form a substantially cylindrical shape extending from the front end portion of the casing 94 toward the right side so as to penetrate the casing 94.

The extending portion 86B may protrude from the right end face of the upper end portion of the main body 86A in the right direction and may be formed as a protrusion with a substantially arc shape extending in the front-rear direction along the circumference of the main body 86A in the side view. The front end portion of the extending portion 86B may be chamfered to slant in the left direction and downward. The read end of the extending portion 86B may be chamfered to slant in the right direction, the rear direction, and downward. Further, a right surface 86E of the extending portion 86B may be formed as a plane extending in the vertical direction in the front rear direction.

The rib 86C may be formed in the interior of the extending portion 86B in a substantially center portion of the main body 86A along the front-rear direction (e.g., the radial extension direction of the main body 86A). The rib 86C may protrude from the main body 86A and interior surface of the extending portion 86B toward the interior side and may be formed as a protrusion extending in the right-left direction. The right end of the rib 86C may be chamfered to slant in the left direction and downward.

Figure 5A:
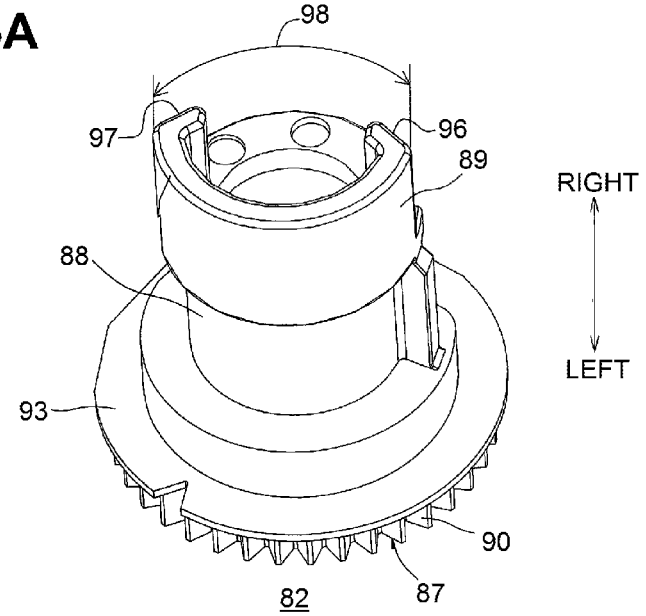
FIGS. 5A and 5B are diagrams showing the cartridge detection gear shown in FIG. 4.
Figure 5B:
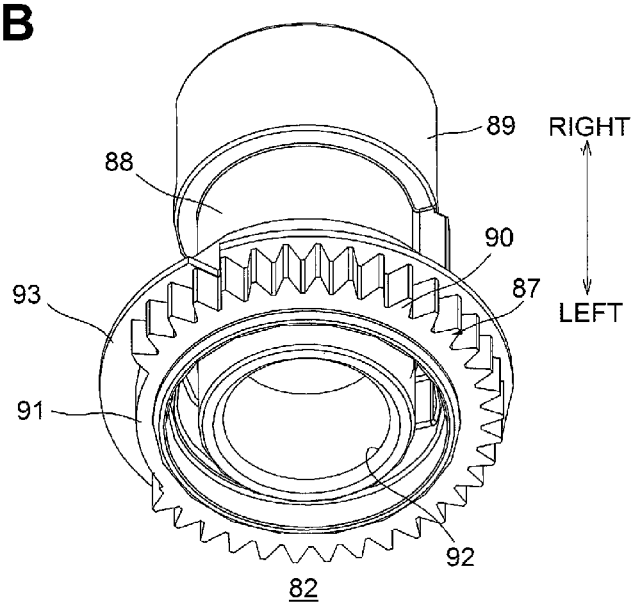

As shown in FIG. 4 and FIGS. 5A and 5B, a cartridge detection gear 82 may be formed from plastic materials with insulating properties (e.g., polyacetal plastic) with a substantially cylindrical shape extending in the right-left direction.

Further, the new cartridge detection gear 82 may comprise a sector gear 87, a cylinder portion 88, and an end portion 89 in an integrated manner.

The sector gear 87 may form a substantially disc shape with a thickness in the right-left direction. Gear teeth may be formed around a portion of the circumference of the sector gear 87 substantially equal to a center angle of 315°. Thus, the circumference of the sector gear 87 may comprise a teeth portion 90, which may be formed with gear teeth, and toothless portion 91, which may be formed without gear teeth.

Further, the radial center portion of the sector gear 87 may form a power receiving portion insertion hole 92.

The power receiving portion insertion hole 92 may form a substantially circular form in the side view and may share the same axis of rotation with the sector gear 87. The diameter of the power receiving portion insertion hole 92 may be larger than the outer diameter of the power receiving portion 86 in the electrode member 81.

The cylinder portion 88 may protrude from the outer edge portion of the power receiving portion insertion hole 92 of the sector gear 87 in the right direction and may form a substantially cylindrical shape that may share the same rotational axis with the sector gear 87. The inner diameter of the cylinder portion 88 may be substantially the same size as the diameter of the power receiving portion insertion hole 92. The cylinder portion 88 may comprise a flange portion 93 and a bias portion 95 (shown in FIG. 4).

The flange portion 93 may be formed as a protrusion extending around the cylinder portion 88 and may protrude outward in the radial direction from the exterior surface of the cylinder portion 88 at the left end portion of the cylinder portion 88.

The bias portion 95 may be formed as a protrusion with a substantially wedge shape protruding outwards in the radial direction from the exterior surface of the cylinder portion 88 (shown in FIGS. 7A and 7B) at the right side of the flange portion 93.

The end portion 89 may be formed with a partial cylindrical shape with a center angle of about 120° and may extend from the right end portion of the cylinder portion 88 in the right direction.

Further, the downstream edge of the end portion 89 in a clockwise direction in the right view may be formed with a downward slanting face 97 (e.g., in a bottom-front direction as shown in FIG. 4), which may slant toward the outside, extend in the radial direction, and run in a clockwise direction upward in the right view. In addition, the upstream edge of the end portion 89 in a clockwise direction in the right view may be formed with an upward slanting face 96 (e.g., in a top-front direction as shown in FIG. 4), which may slant toward the inside, extend in the radial direction, and run in a clockwise direction upward in the right view.

Figure 7A:
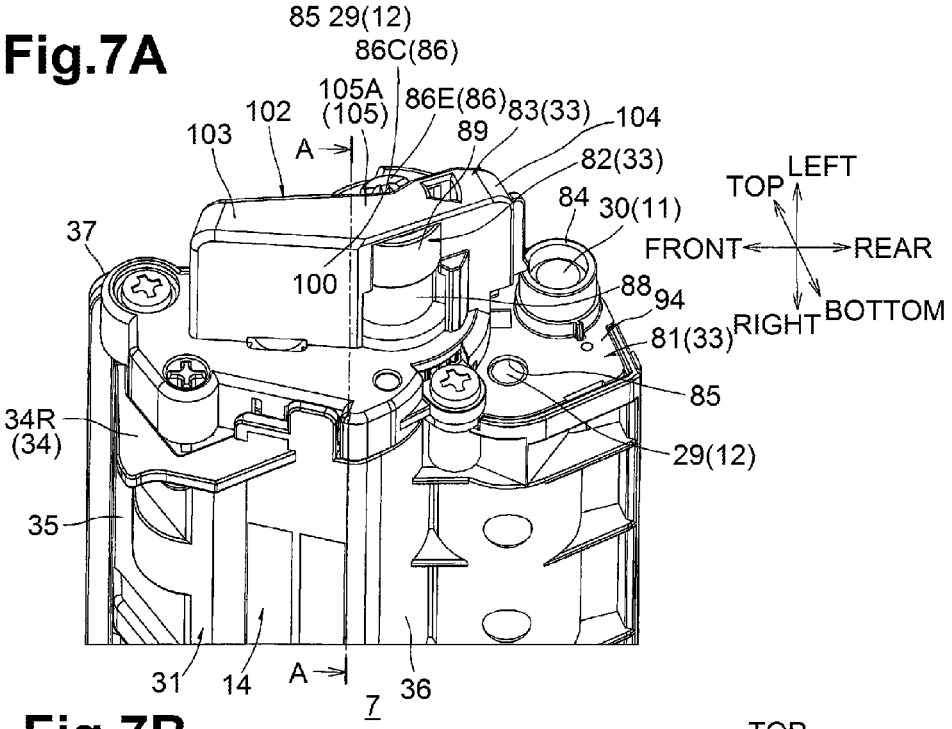
FIGS. 7A and 7B are diagrams showing the developing cartridge shown in FIG. 2.

As shown in FIG. 4 and FIG. 7A, the cover 83 may form a substantially tubular shape extending in the right-left direction and with a right end that may be closed. The cover 83 may be formed such that the cover 83 may cover both a new cartridge detection gear 82 and a second agitator gear 66 (e.g., may be appropriately large in both the front-rear direction and vertical direction). Further, the cover 83 may comprise a power receiving portion exposure opening 101 and a power receiving portion protecting portion 102.

The power receiving portion exposure opening 101 may be formed as a through-hole with a substantially circular shape at the right wall of a substantially center portion of the cover 83 along the right-left direction so as to expose the end portion 89 in the new cartridge detection gear 82.

The power receiving portion protecting portion 102 may comprise a first protecting portion 103 that may cover a portion of the power receiving portion 86 at the front side thereof, a second protecting portion 104 that may cover a portion of the power receiving portion 86 at the rear side thereof, and a third protecting portion 105 that may cover a portion of the power receiving portion 86 at the right side thereof.

The first protecting portion 103 may form a substantially prismatic shape protruding from the front edge of the power receiving portion exposure opening 101 in the right direction.

The second protecting portion 104 may form a substantially prismatic shape protruding from the rear edge of the power receiving portion exposure opening in the right direction.

The third protecting portion 105 may form a substantially plate shape extending in the right-left direction and may be disposed between the right end portion of the first protecting portion 103 and the right end portion of the second protecting portion 104. An upper edge 100 of the third protecting portion 105 may form a substantially V-shaped shape in the side view. Specifically, the upper edge 100 of the third protecting portion 105 may connect to the rear side of the top edge of the first protecting portion 103 and extend toward the front side, may curve around the right side of a substantially center portion of the power receiving portion exposure opening 101 along the front-rear direction and toward the top, and may connect to the upper edge on the front side of the second protecting portion 104. Further, a right surface 105A of the third protecting portion 105 may be formed as a plane surface extending in the vertical direction and the front-rear direction. In addition, the third protecting portion 105 may comprise a fitting portion 106.

The fitting portion 106 may be arranged at the right side of a substantially center portion of the power receiving portion exposure opening 101 along the front-rear direction. The fitting portion 106 may form a substantially cylindrical shape protruding from the left surface of the third protecting portion 105 in the left direction. The upper end of the fitting portion 106 may form a substantially V-shaped shape in the side view and may follow along the upper edge of the third protecting portion 105. The outer diameter of the fitting portion 106 may be substantially the same size as or slightly smaller than the inner diameter of the power receiving portion 86.

As shown in FIG. 4 and FIG. 6, the electrode member 81 may be installed to the right side of the right wall 34R so that the right end portion of the developing roller shaft 30 may be inserted into the developing roller shaft supporting portion 84 to enable rotation thereof, and the right end portion of the supply roller shaft 29 may be inserted into the supply roller shaft supporting portion 85 to enable rotation thereof.

Consequently, the right end portion of the developing roller shaft 30 may be rotatably supported in the developing roller shaft supporting portion 84. Further, the right end of the supply roller shaft 29 may be rotatably supported in the supply roller shaft supporting portion 85.

Also, the upper-rear end portion of the power receiving portion 86 may be arranged to overlap the coupling 61 when projected in the right-left direction (shown in FIG. 4).

The new cartridge detection gear 82 may be fitted to the power receiving portion 86 of the electrode member 81 to enable rotation thereof. Consequently, the lower half of the right end portion of the power receiving portion 86 may be covered at the bottom by the end portion 89. Further, the upper half of the right end of the power receiving portion 86 may be exposed from the downward slanting face 97 to the upward slanting face 96. Thus, the space between the downward slanting face 97 and the upward slanting face 96 may be a first exposed portion 98 that may expose the power receiving portion 86 (shown in FIGS. 5A and 5B).

Further, the upper end portion of the new cartridge detection gear 82 may be arranged to overlap the coupling 61 when projected in the right-left direction (shown in FIG. 4).

Further, the new cartridge detection gear 82 may be biased in a clockwise (e.g., in the right side view) manner by a torsion coil spring 107. Specifically, the torsion coil spring 107 may be formed from a metal, and may comprise a coil portion 108, a fixed end portion 109, and a bias end portion 110. The coil portion 108 may form a helix shape that may wrap around clockwise (e.g., in the right side view) and may travel from the right side toward the left side. The fixed end portion 109 may form a substantially straight line shape that may connect at the left end of the coil portion 108 and may extend in the front direction. The bias end portion 110 may form a substantially L-shaped shape that may connect at the right end of the coil portion 108, may extend toward the rear side, and may curve around the rear end thereof in the downward direction.

Further, the torsion coil spring 107 may be supported in the cover 83 by the coil portion 108, and, at the same time, may be fixed to the upper-front end of the right wall 34R by the fixed end portion 109. In addition, the bias end portion 110 may abut the bias portion 95 in the new cartridge detection gear 82 from the upper-front side.

Consequently, the new cartridge detection gear 82 may abut around clockwise e.g., in the right side view), and the end portion of the blade member 90 in the sector gear 87, which rotates downward in a clockwise manner in the right side view, may engage with the second agitator gear 66 from the front.

Further, as shown in FIG. 7A, the cover 83 permits the power receiving portion 86 to protrude through the power receiving portion exposure opening 101 therein, and, at the same time, the right wall 34R may be screwed down to collectively cover the new cartridge detection gear 82 and the second agitator gear 66.

At this time, the fitting portion 106 of the cover 83 may fit into the right end portion of the power receiving portion 86 at the lower side of the rib 86C. Consequently, the right end portion of the power receiving portion 86 may be covered from the right side by the third protecting portion 105 regarding the portion below the extending portion 86B and the rib 86C. Thus, at the right end portion of the power receiving portion 86, the portion excluding the extending portion 86B and the rib 86C may be covered by the third protecting portion 105 and may be denoted as a second covered portion 86D (shown in FIG. 4).

Figure 7B:
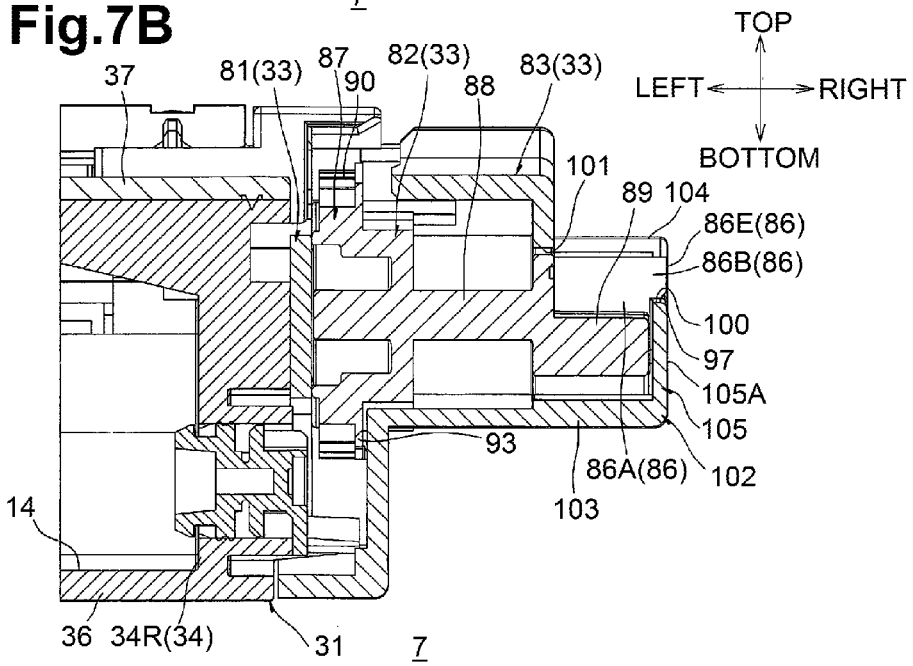

Further, as shown in FIG. 7B, the extending portion 86B of the power receiving portion 86 may engage with the upper edge 100 of the third protecting portion 105 of the cover 83 from the top side so that the right surface 86E thereof may be substantially flush with the a right surface 105A of the third protecting portion 105. Thus, the extending portion 86B of the power receiving portion 86 may be arranged to overlap the third protecting portion 105 of the cover 83 when projected vertically. Further, the right surface 86E of the extending portion 86B of the power receiving portion 86 may be arranged to overlap the right surface 105A of the third protecting portion 105 of the cover 83 when projected vertically. Consequently, the right surface 86E of the extending portion 86B may be exposed toward the right side at the upper side of the upper edge 100 of the third protecting portion 105.

Figure 8:
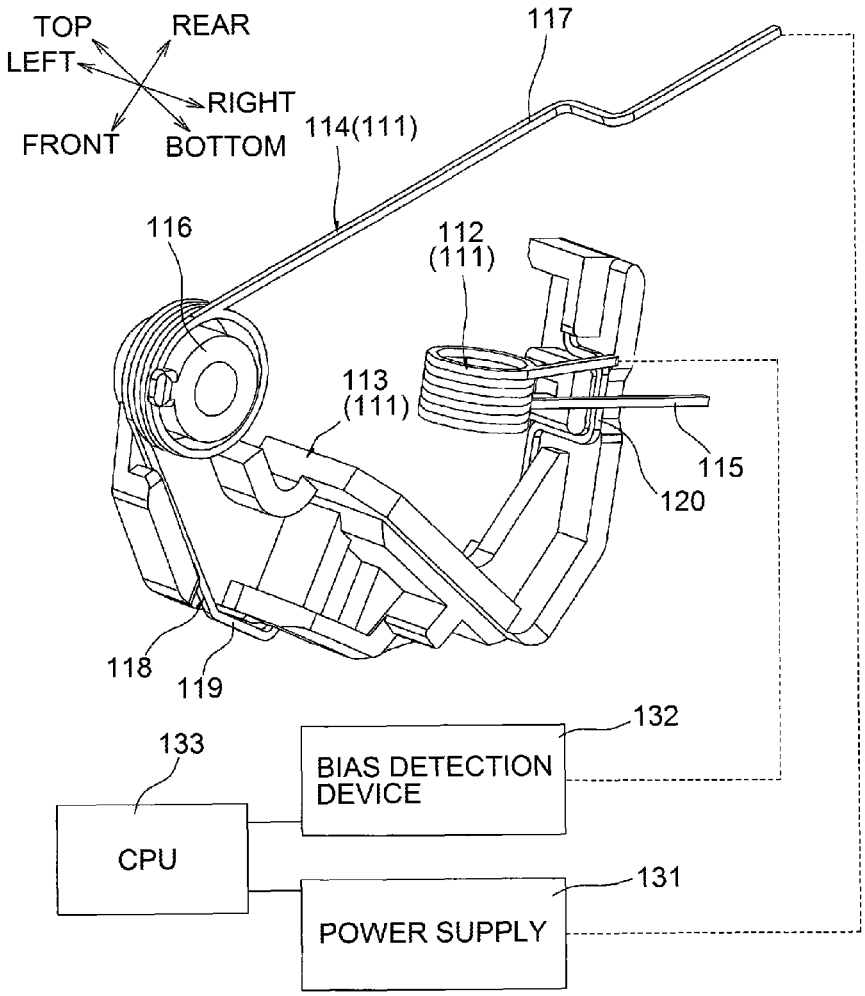
FIG. 8 is a diagram showing a perspective view of the electrode device.
Figure 9:
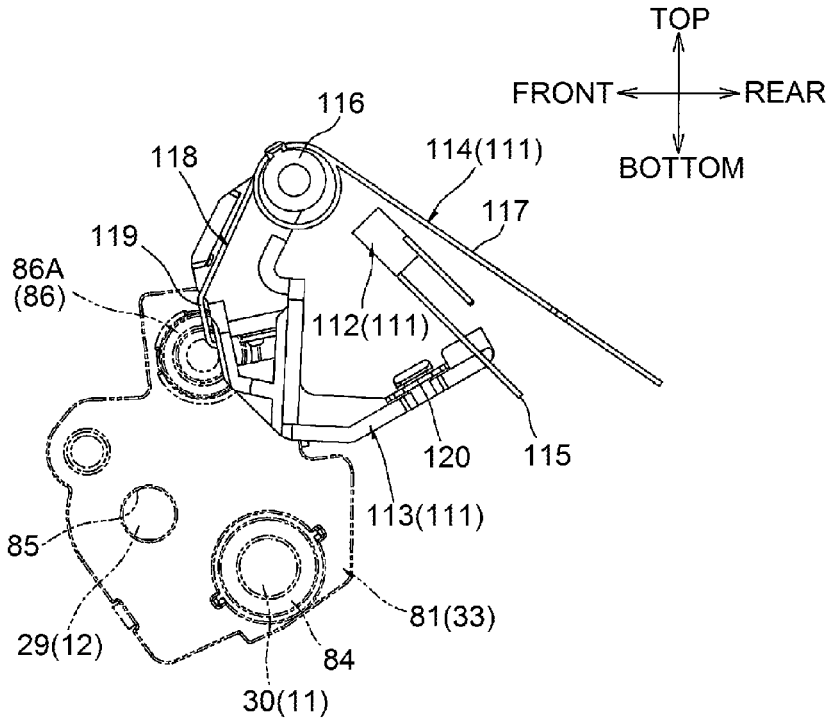
FIG. 9 is a diagram illustrating a swinging of a swinging electrode that shows a state in which the swinging electrode is arranged in a lower released position and the developing cartridge is not attached to the casing.

As shown in FIG. 8 and FIG. 9, the casing may comprise an electrode device 111 configured to supply developer bias to the developing cartridge 7 within the casing 2.

The electrode device 111 may comprise a fixed electrode 112, a holder member 113, and a swinging electrode 114.

The fixed electrode 112 may be a coil spring formed of metal, and a portion thereof may be fixed near the right side of the developing cartridge 7 within the casing 2.

The holder member 113 may be disposed at the left side of the fixed electrode 112. The holder member 113 may be formed from plastic materials with insulating properties and may form a substantially curved shaft shape, which may be substantially U-shaped, extending in the front-rear direction where the upper-rear side opens. The upper end of the holder member 113 may comprise a tubular portion 116 that may form a substantially cylindrical shape extending in the right-left direction, and the tubular portion 116 may be rotatably fitted onto a swinging shaft (not shown) within the casing 2.

The swinging electrode 114 may be a coil spring formed of metal that may wrap around the tubular portion 116, and a portion thereof may be a fixed portion 117 that may be fixed near the right side of the developing cartridge 7 within the casing 2; and another portion thereof may be an electrode portion 118 fixed to the holder member 113.

The electrode portion 118 may comprise a developer side contact 119 that may contact the power receiving portion 86 of the developing cartridge 7, and a casing side contact 120 that may contact with the free end of the fixed electrode 112. The developer side contact 119 may be supported at the front end portion of the holder member 113 and may be exposed to the lower-front side. The casing side contact 120 may be supported at the lower-rear end portion of the holder member 113 so as to be disposed at the left side of a free end portion 115 of the fixed electrode 112 and may be exposed to the right side.

Further, as shown in FIG. 9, the swinging electrode 114 may be normally held in a lower separated position, due to the elastic properties thereof, so that the casing side contact 120 may be separated from the free end 115 in the fixed electrode 112.

Figure 10:
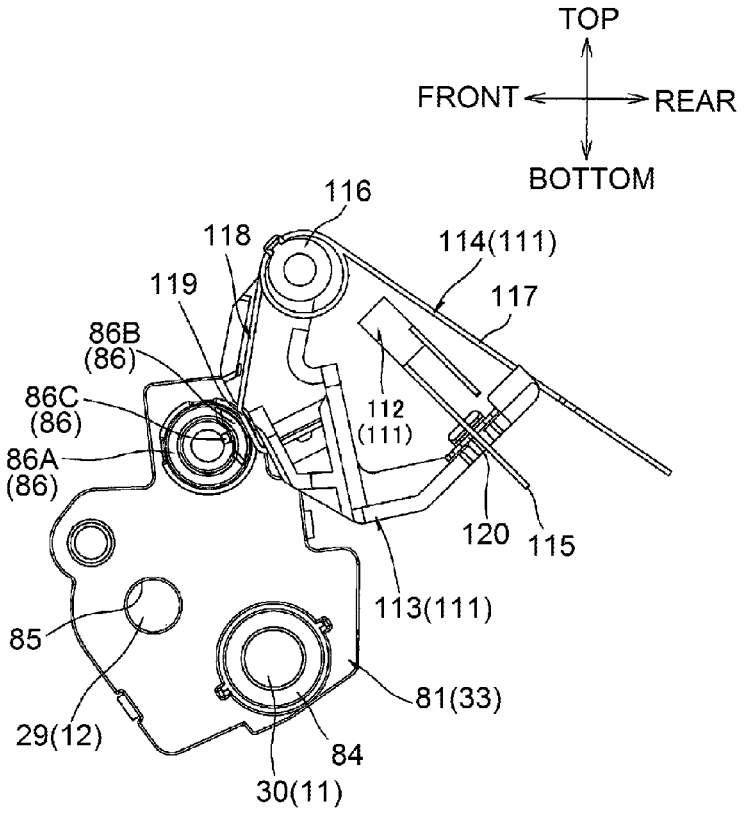
FIG. 10 is a diagram illustrating the swinging of the swinging electrode that shows a state in which the swinging electrode is arranged in a connected position and the developing cartridge is attached to the casing.

Moreover, as shown in FIG. 10, the swinging electrode 114 may swing counter-clockwise from the right view against this elastic force by being pushed from the front side, and the casing side contact 120 may be disposed at a connected position and may contact with the free end portion 115 of the fixed electrode 112.

Figure 11:
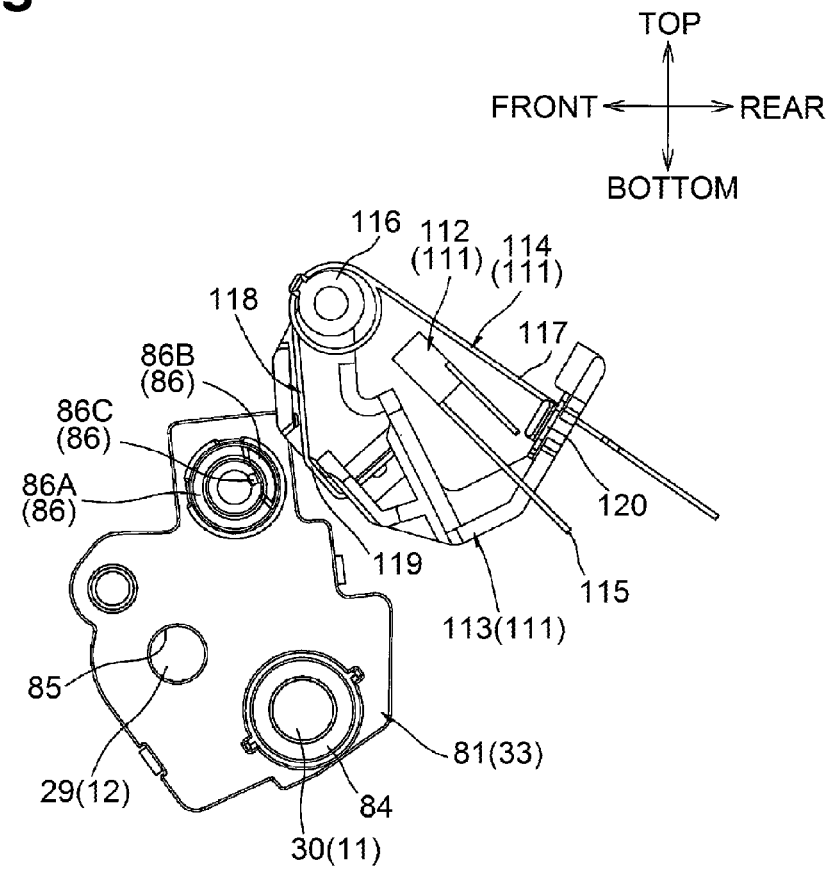
FIG. 11 is a diagram illustrates a swinging of a swinging electrode that shows a state in which the swinging electrode is arranged in an upper released position and the developing cartridge is attached to the casing.

In addition, as shown in FIG. 11, the swinging electrode 114 may swing counter-clockwise from the right view against this elastic force by being further pushed from the front, and the casing side contact 120 may be disposed at an upper separated position separated from the free end 115 of the fixed electrode 112.

Further, as shown in FIG. 8, a power supply 131, a bias detection device 132, and a central processing unit ("CPU") 133 may be provided within the casing 2.

The power supply 131 may be electrically connected to the fixed portion 117 of the swinging electrode 114. The power supply 131 may supply developer bias to the swinging electrode 114.

The bias detection device 132 may be electrically connected to the fixed electrode 112. The bias detection device 132 may detect the developer bias supplied from the power supply 131 to the fixed electrode 112 through the swinging electrode 114.

The CPU 133 may be electrically connected to the bias detection device 132. The CPU 133 may determine the state of the developing cartridge 7 on the basis of the detection of whether the developer bias has been supplied to the fixed electrode 112 via the bias detection device 132. When there is a detection that the developer bias has been supplied to the fixed electrode 112 from the power supply 131 by the bias detection device 132, the CPU 133 may determine that the swinging electrode 114 is disposed at the connected position. Further, when there is no detection that the developer bias has been supplied to the fixed electrode 112 from the power supply 131 by the bias detection device 132, the CPU 133 may determine that the swinging electrode 114 is disposed at the lower separated position or the upper separated position.

The new cartridge detection operation of the developing cartridge 7 now is described with reference to FIGS. 8 through 14.

As shown in FIG. 9, when the process cartridges 5 are not attached within the casing 2, the swinging electrode 114 may be held at the lower separated position.

At this time, the developing cartridge 7 may not be attached within the casing 2, so the developer bias may not be supplied from the cartridge frame 31 to the developing cartridge 7 and the fixed electrode 112, and the bias detection device 132 may not detect that the developer bias has been supplied from the power supply 131 to the fixed electrode 112. Consequently, the CPU 133 may determine that the developer bias has not been supplied to the fixed electrode 112.

Thus, when the bias detection device 132 does not detect that the developer bias has been supplied to the fixed electrode 112 after a predetermined amount of time, the CPU 133 may determine that the developing cartridge 7 has been removed from the casing 2.

Further, when the top cover 4 of the casing 2 is opened, and a process cartridge 5 with a new (e.g., unused) developing cartridge 7 attached thereto is inserted into the casing 2 from the upper-front side, the power receiving portion 86 in the developing cartridge 7 may abut with the holder member 113 from the upper-front side.

In addition, when the developing cartridge 7 is further inserted into the casing 2, pressure may be applied to the holder member 113 by the power receiving portion 86 in the developing cartridge 7, and the electrode portion 118 of the swinging electrode 114 may swing counter-clockwise from the right side view together with the holder member 113.

Figure 12:
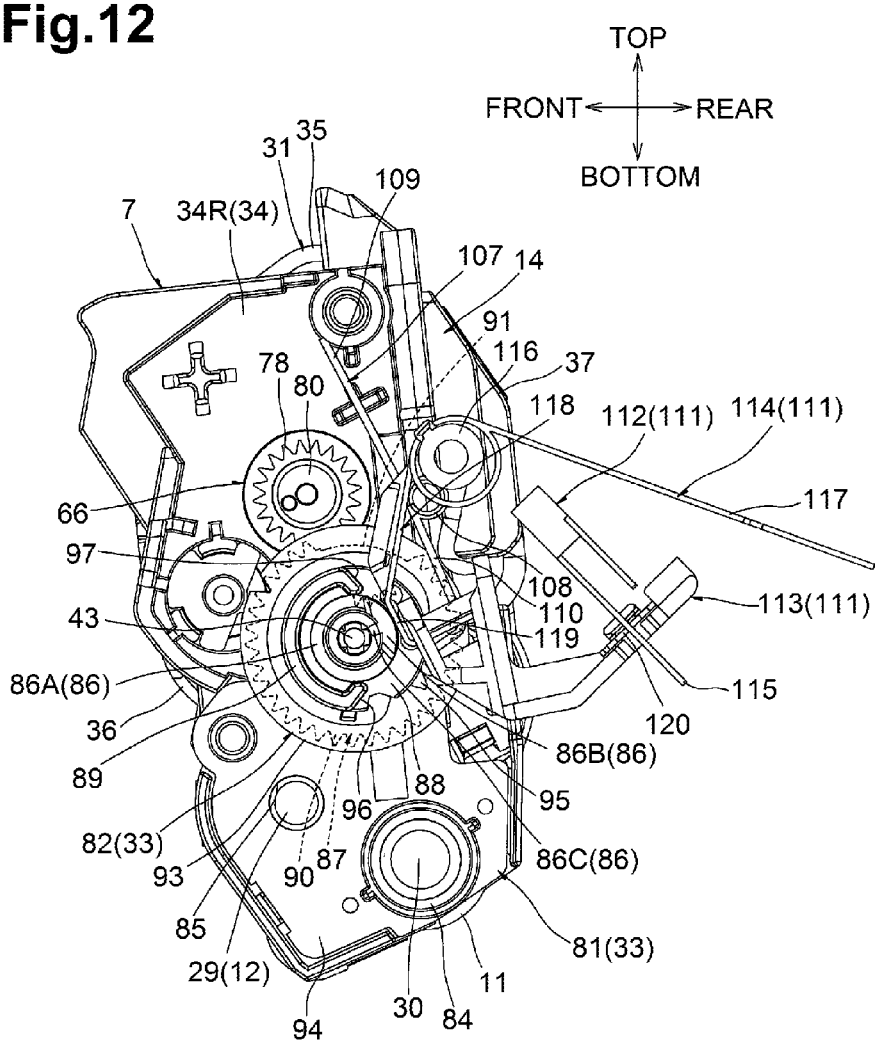
FIG. 12 is a diagram illustrating a new (e.g., unused, newly installed) cartridge detection operation for detecting the developing cartridge that shows that the swinging electrode of the casing electrode device makes contact with the power receiving portion of the developing cartridge immediately after the developing cartridge is attached to the casing.

Moreover, as shown in FIG. 10 and FIG. 12, subsequent to attaching the developing cartridge 7 into the casing 2, the developer side contact 119 on the swinging electrode 114 may contact the power receiving portion 86 of the developing cartridge 7 through the space between the downward slanting face 97 and the upward slanting face 96 of the end portion 89 from the rear side. In addition, the swinging electrode 114 may be arranged in the connected position, and the casing side contact 120 may make contact with the free end 115 of the fixed electrode 112. Further, the downward slanting face 97 on the end portion 89 may be arranged to the front side of the holder member 113 and the swinging electrode 114.

As a result, the developer bias supplied from the power supply 131 to the swinging electrode 114 may be supplied to the power receiving portion 86 of the developing cartridge 7 through the developer side contact 119.

The developer bias supplied to the power receiving portion 86 of the developing cartridge 7 may be applied to the developing roller shaft 30 through the electrode member 81.

Further, the developer bias supplied to the swinging electrode 114 may be supplied from the casing side contact 120 to the fixed electrode 112 through the free end 115 in the fixed electrode 112, and subsequently may be detected by the bias detection device 132.

Thus, the CPU 133 may determine the developer bias has been supplied to the fixed electrode 112.

In contrast, as shown in FIG. 2, when the developing cartridge 7 is attached to the casing 2, the front end of a casing coupling 121 of the casing 2 may be inserted into the connecting depression 70 of the coupling 61, which may prevent relative rotation therebetween. Thus, drive power may be input to the coupling 61 from the casing 2 via the casing coupling 121, and the warm-up operation may start.

Thus, as shown in FIG. 3, the drive power may be transferred from the coupling 61 to the agitator shaft 16 through the idle gear 64 and the first agitator gear 65, and the agitator 15 may be rotated.

Moreover, as shown in FIG. 4, once the agitator 15 is rotated, the drive power may be transferred to a teeth portion 90 in the sector gear 87 of the new cartridge detection gear 82 through the agitator shaft 16 and the second agitator gear 66, and the new cartridge detection gear 82 may be rotated clockwise in the right side view.

Figure 13:
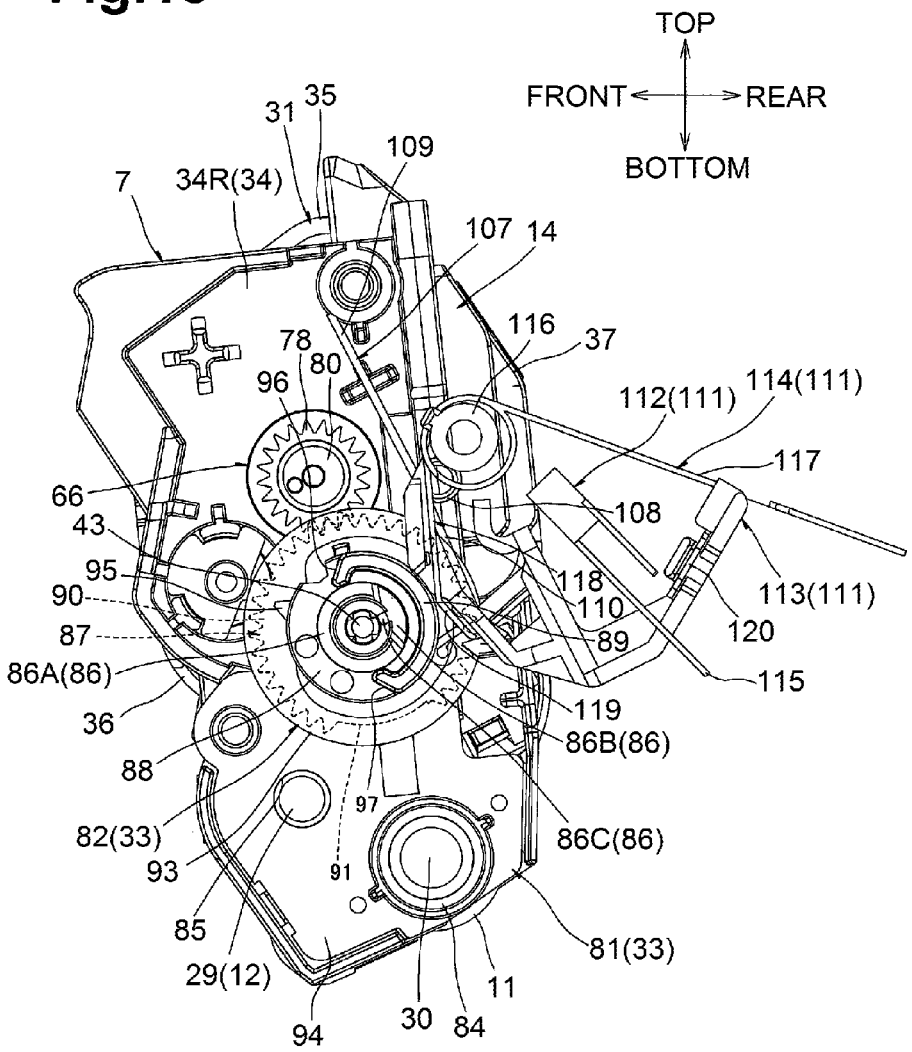
FIG. 13 is a diagram illustrating the new cartridge detection operation for detecting the developing cartridge that shows that the swinging electrode of the casing electrode device is separated from the power receiving portion of the developing cartridge by pressure from the end portion of the new cartridge detection gear when a warm-up operation is started.

Thus, as shown in FIG. 13, the downward slanting face 97 on the end portion 89 of the new cartridge detection gear 82 may abut with the electrode portion 118 of the swinging electrode 114 from the front side, and pressure may be applied to the electrode portion 118 of the swinging electrode 114 toward the rear side. Consequently, the holder member 113 and the swinging electrode 114 may rise over the end portion 89 along the downward slanting face 97 on the end portion 89 against the elastic force of the swinging electrode 114 and may separate from the power receiving portion 86 in the developing cartridge 7 toward the rear side, such that the holder member 113 and the swinging electrode 114 may be disposed at the upper separated position.

Thus, the developer side contact 119 of the swinging electrode 114 may separate from the power receiving portion 86 in the developing cartridge 7 toward the rear side, and the electrical connection between the swinging electrode 114 and the power receiving portion 86 may be released. Also, the casing side contact 120 on the swinging electrode 114 may be separated from the free end portion 115 of the fixed electrode 112 toward the top side, and the electrical connection between the swinging electrode 114 and the fixed electrode 112 may be released. Further, when the new cartridge detection gear 82 is formed from one or more electroconductive materials, the electrical connection between the power receiving portion 86 and the swinging electrode 114 may not be released, but the electrical connection between the swinging electrode 114 and the fixed electrode 112 may be released. At this time, the CPU 133 may determine that the developer bias may not be supplied to the fixed electrode 112.

Further, when the new cartridge detection gear 82 is further rotated clockwise in the right side view, the end portion 89 of the new cartridge detection gear 82 may travel between the power receiving portion 86 and the holder member 113 from the upper-front side to the lower-rear side.

Figure 14:
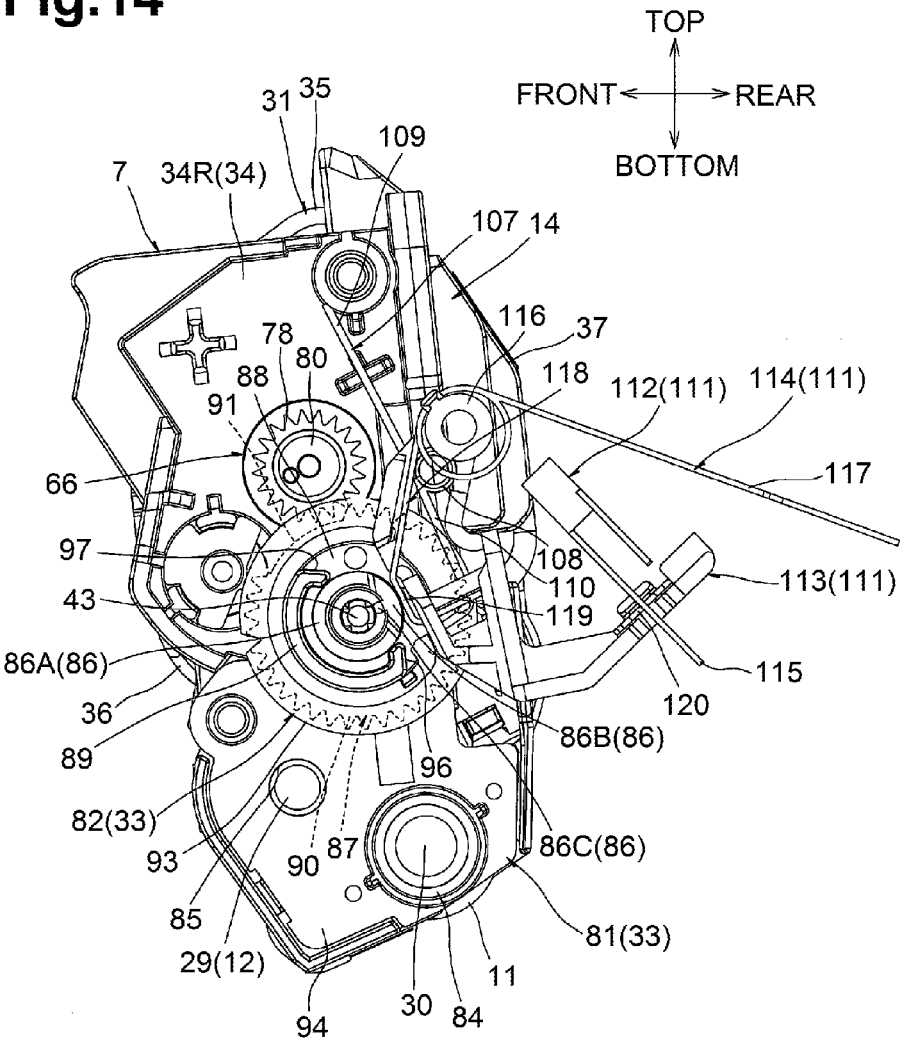
FIG. 14 is a diagram illustrating the new cartridge detection operation for detecting the developing cartridge that shows that the end portion of the new cartridge detection gear travels between the swinging electrode of the casing electrode device and the power receiving portion of the developing cartridge and that the swinging electrode of the casing electrode device is connected to the power receiving portion of the developing cartridge.

Thus, as shown in FIG. 14, the holder member 113 and the swinging electrode 114 may swing toward the front side due to the elastic force of the swinging electrode 114 so as to lower from the end portion 89 along the downward slanting face 97 on the end portion 89 and may return to being disposed at the connected position.

Thus, the developer side contact 119 of the swinging electrode 114 may contact the power receiving portion 86 of the developing cartridge 7 from the front side, and the swinging electrode 114 and the power receiving portion 86 may be electrically connected. Further, the casing side contact 120 may contact the free end portion 115 of the fixed electrode 112, and the swinging electrode 114 and the fixed electrode 112 may be electrically connected. Further, when the new cartridge detection gear 82 is formed from electroconductive materials, the swinging electrode 114 and the power receiving portion 86 may remain electrically connected.

Consequently, the CPU 133 may determine that the developer bias is supplied to the fixed electrode 112. Thus, after the warm-up operation has started, the CPU 133 may make several determinations over time: that the developer bias has been supplied to the fixed electrode 112 at a first time, that the developer bias is not supplied to the fixed electrode 112 at a second time, and that the developer bias has been supplied to the fixed electrode 112 at a third time, in this order, for example.

Thus, the new cartridge detection gear 82 disposes the swinging electrode 114 at the connected position. Subsequently, the new cartridge detection gear 82 may move the swinging electrode 114 from a first position, in which electric power may be supplied to the power receiving portion 86 of the developing cartridge 7 through the space between the downward slanting face 97 and the upward slanting face 96 of the end portion 89, to a second position, in which the input of electric power to the power receiving portion 86 of the developing cartridge 7 by the end portion 89 may be disrupted. Thereafter, the new cartridge detection gear 82 may move the swinging electrode 114 at the connected position to a third position, in which electric power may be again supplied to the power receiving portion 86 of the developing cartridge 7 through the space between the downward slanting face 97 and the upward slanting face 96 of the end portion 89.

When the new cartridge detection gear 82 is further rotated, the toothless portion 91 of the new cartridge detection gear 82 may align with the second agitator gear 66, the engagement between the teeth portion 90 of the new cartridge detection gear 82 and the second agitator gear 66 may be released, and the rotational drive of the new cartridge detection gear 82 may be stopped. Subsequently; the warm-up operation may complete.

Thus, by determining that the developer bias has been supplied to the fixed electrode 112 at a first time, that the developer bias is not supplied to the fixed electrode 112 at a second time, and that the developer bias has been supplied to the fixed electrode 112 at a third time, in this order, after the warm-up operation has started, the CPU 133 may complete the determination that the developing cartridge 7 is a new cartridge (e.g., unused).

In addition, an association may be made based on a determination by the CPU 133 of the time period over which the developer bias is not supplied to the fixed electrode 112 between the amount of time over which the developer bias is not supplied to the fixed electrode 112 and the maximum number of image formations. Specifically, an association may be made so that when amount of time over which the developer bias is not supplied to the fixed electrode 112 is great, for example, this may correspond to a maximum number of image formations of 6000, and when amount of time over which the developer bias is not supplied to the fixed electrode 112 is small, this may correspond to a maximum number of image formations of 3000.

Further, as previously described, after the warm-up operation has started, the CPU 133 may determine that the developer bias is not supplied to the fixed electrode 112 at a second time, and that the developer bias has been supplied to the fixed electrode 112 at a third time, in this order; and, during this process, when amount of time over which the developer bias is not supplied to the fixed electrode 112 is great, the maximum number of image formations for the developing cartridge 7 may be determined to be 6000.

Consequently, when a new developing cartridge 7 is attached, the CPU 133 may determine that this developing cartridge 7 is a new cartridge, and also that the maximum number of image formations for this developing cartridge 7 is 6000. Therefore, a notification may be displayed on an operation panel or similar (not shown) that the developing cartridge 7 needs to be replaced just before the actual number of image formations exceeds 6000 image formations from the time that the developing cartridge 7 was attached.

In contrast, when it is determined that the developer bias is supplied to the fixed electrode 112 longer than a predetermined amount of time, the CPU 133 may determine that the developing cartridge 7 is attached in the casing 2.

As previously described, when a new developing cartridge 7 is attached, the attaching of the developing cartridge 7 in the casing 2 may be determined by the implementation of the new cartridge detection operation. In contrast, when the developing cartridge 7 is removed from the casing 2 after a new developing cartridge 7 is attached due to a paper jam of the paper P or some other reason, the new cartridge detection gear 82 may stop at the position where the toothless portion 91 of the sector gear 87 aligns with the second agitator gear 66. For this reason, when the developing cartridge 7 is reattached and the warm-up operation is executed, the new cartridge detection gear 82 may not be rotationally driven, and the new cartridge detection operation may not be implemented. At this time, the holder member 113 and the swinging electrode 114 may be arranged in the connected position, and it may be determined that the developer bias is continually supplied to the fixed electrode 112.

Consequently, the CPU 133 may not accidentally determine that this reattached (e.g., used) developing cartridge 7

(e.g., old developing cartridge 7) is a new cartridge, and the comparison between the maximum number of image formations at the time the developing cartridge 7 was determined to be a new cartridge and the actual number of image formations may be retained. Further, the CPU 133 may determine that the developing cartridge 7 is attached in the casing 2.

As shown in FIG. 6, regarding the developing cartridge 7, the tower half of the power receiving portion 86 may be covered by the end portion 89, which may be disposed at the power receiving portion 86 and may protrude from the electrode member 81; and the new cartridge detection gear 82, which may expose the upper half of the power receiving portion 86 from the space between the downward slanting face 97 and the upward slanting face 96, may be rotatably supported.

Consequently, electric power may be supplied from the electrode device 111 of the casing 2 to the power receiving portion 86 through the exposed space between the downward slanting face 97 and the upward slanting face 96, and the supply of electric power from the electrode device 111 to the power receiving portion 86 by the rotation of the new cartridge detection gear 82 may be disrupted by the end portion 89 when the end portion 89 is moved between the electrode device 111 and the power-receiving portion 86. Thus, information about the developing cartridge 7 may be detected by a simple configuration without the providing of an actuator and a light sensor.

Further, as shown in FIG. 4, regarding the developing cartridge 7, a cover 83 may comprise the third protecting portion 105, which may cover the lower-right end portion of the power receiving portion 86 (e.g., a second covered portion 86D) from the right side. Thus, the lower-right end portion of the power receiving portion 86 (e.g., the second covered portion 86D) may be protected from the right side by the third protecting portion 105.

Further, as shown in FIG. 7B, regarding the developing cartridge 7, the extending portion 86B of the power receiving portion 86 may protrude from the right end of the main body 86A and may be exposed from the third protecting portion 105 of the cover 83. Thus, the lower-right end portion of the power receiving portion 86 may be protected, and the right-side length of the extending portion 86B of the power receiving portion 86 may be exposed. Consequently, the electrode device 111 of the casing 2 may provide easy access to the power receiving portion 86, and electric power may be readily supplied from the casing 2 to the power receiving portion 86.

Further, as shown in FIG. 7B, regarding the developing cartridge 7, the extending portion 86B of the power receiving portion 86 may be disposed to overlap the top side of the third protecting portion 105 of the cover 83. Thus, electric power may be supplied from the electrode device 111 of the casing 2 to the extending portion 86B of the power receiving portion 86 at the upper side of the third protecting portion 105. Consequently, electric power may be more readily supplied from the electrode device 111 of the casing 2 to the extending portion 86B on the power receiving portion 86.

Further, as shown in FIG. 7A, regarding the developing cartridge 7, the extending portion 86B of the power receiving portion 86 may engage with the upper edge 100 of the third protecting portion 105 of the cover 83. Thus, when the electric power is supplied from the electrode device 111 of the casing 2 to the power receiving portion 86, the extending portion 86B of the power receiving portion 86 may be supported by the third protecting portion 105 of the cover 83, and the electrode device 111 may make contact with the power receiving portion 86. Consequently, contact between the electrode device 111 and the power receiving portion 86 may be reliably made, and the electric power may be reliably supplied from the electrode device 111 to the power receiving portion 86.

Thus, the position of the power receiving portion 86 with respect to the new cartridge detection gear 82 may be determined by the fitting portion 106.

Further, when the electric power is supplied from the electrode device 111 of the casing 2 to the power receiving portion 86, fitting the fitting portion 106 with the right end of the power receiving portion 86 may enable the power receiving portion 86 to be more reliably supported by the third protecting portion 105. Thus, contact between the electrode device 111 and the power receiving portion 86 may be made in a reliable manner, and the electric power may be more reliably supplied from the electrode device 111 to the power receiving portion 86.

Further, as shown in FIGS. 7A and 7B, regarding the developing cartridge 7, fitting the fitting portion 106 inside the right end portion of the power receiving portion 86 may strengthen the right end of the power receiving portion 86.

In addition, as shown in FIG. 6, regarding the developing cartridge 7, the fitting protrusion 43 that may protrude toward the right side to fit inside the power receiving portion 86 may be provided on the right wall 34R in the cartridge frame 31. Consequently, the power receiving portion 86 may be strengthened by the fitting protrusion 43.

Further, as shown in FIG. 12 and FIG. 14, regarding the developing cartridge 7, the supply of electric power to the power receiving portion 86 may be detected before and after the input of electric power to the power receiving portion 86 is disrupted. Thus, when the new cartridge detection gear 82 is in the first position (shown in FIG. 12) and the third position (shown in FIG. 14). Consequently, the disruption of the input of electric power to the power receiving portion 86 may be reliably recognized by the bias detection device 132 of the casing 2.

Moreover, as shown in FIG. 6, regarding the developing cartridge 7, the end portion 89 of the new cartridge detection gear 82 may extend toward the rotational direction of the new cartridge detection gear 82 (e.g., clockwise in the right view). Thus, the supply of electric power and the disruption of this supply from the electrode device 111 of the casing 2 to the power receiving portion 86 may be switched by the rotation of the new cartridge detection gear 82.

Further, regarding the developing cartridge 7, the length of the rotational direction of the end portion 89 of the new cartridge detection gear 82 may correspond to information related to the cartridge. Thus, the developing cartridge 7 information may be readily and reliably determined on the basis of the length of the rotational direction of the end portion 89.

Further, as shown in FIG. 7A, regarding the developing cartridge 7, the end portion 89 of the new cartridge detection gear 82 may cover the power receiving portion 86 from the radial direction. Thus, the power receiving portion 86 may be protected from the radial direction by the end portion 89 of the new cartridge detection gear 82.

Further, as shown in FIG. 12, regarding the developing cartridge 7, the new cartridge detection operation may separate the electrode device 111 of the casing 2 so as to rise above the end portion 89 along the downward slanting face 97, and, as shown in FIG. 14, thereafter may lower the electrode device 111 from the end portion 89 along the upward slanting face 96, such that the electrode device 111 may make contact with the power receiving portion 86. Thus, the end portion 89

I the new cartridge detection gear 82 may smoothly travel in the space between the power receiving portion 86 and the electrode device 111.

Moreover, as shown in FIGS. 5A and 5B, regarding the developing cartridge 7, the new cartridge detection gear 82 may comprise the sector gear 87, which may comprise the teeth portion 90, through which the drive power from the casing 2 may be transferred, and the toothless portion 91, through which the drive power may not be transferred. Thus, as shown in FIG. 12 through FIG. 14, the new cartridge detection gear 82 may be reliably rotationally driven by a predetermined drive amount from the start of the rotational drive to the end of the rotational drive.

In addition, as shown in FIG. 4, regarding the developing cartridge 7, the electrode member 81 may protrude from the casing 94 toward the right side and may comprise the developing roller shaft supporting portion 84 that may rotatably support the right end portion of the developing roller shaft 30. Thus, the electric power may be reliably supplied from the developing roller shaft supporting portion 84 to the developing roller 11 through a simple configuration.

Further, as shown in FIG. 3 and FIG. 4, regarding the developing cartridge 7, the coupling 61 may be disposed at the right side of the right wall 34R of the cartridge frame 31, and the new cartridge detection gear 82 may be disposed at the left side of the left wall 34L of the cartridge frame 31. Thus, the area of the right wall 34R and the left wall 341, may be smaller, which may enable the size of the developing cartridge 7 to be smaller than in a configuration in which both the coupling 61 and the new cartridge detection gear 82 are both provided on a same one of the right wall 34R and the left wall 34L.

Moreover, as shown in FIG. 3 and FIG. 4, regarding the developing cartridge 7, the first agitator gear 65 transferring the drive power from the coupling 61 to the agitator 15 may be provided on the right end portion of the agitator shaft 16, and the second agitator gear 66 transferring the drive power from the agitator 15 to the new cartridge detection gear 82 may be provided on the left end portion of the agitator shaft 16. Thus, the drive power may be transferred to the new cartridge detection gear 82 through the agitator 15 using a simple configuration.

In addition, regarding the developing cartridge 7, the number of teeth on the first agitator gear 65 may be more than the number of teeth on the second agitator gear 66. Thus, the rotation speed of the new cartridge detection gear 82 may be less than the rotation speed of the agitator 15. Consequently, the detected amount of time that electric power is supplied to the power receiving portion 86 and the detected amount of time of the disruption of this supply may be detected and obtained accurately.

Further, as shown in FIG. 6, regarding the developing cartridge 7, the new cartridge detection gear 82 may be disposed so that the upper-rear end thereof overlaps the coupling 61 when projected in the right-left direction. Thus, the new cartridge detection gear 82 and the coupling 61 may be disposed at substantially the same vertical position, and the size of the developing cartridge 7 may be still smaller.

Moreover, as shown in FIG. 6, regarding the developing cartridge 7, the power receiving portion 86 may be disposed so that the upper-rear end thereof overlaps the coupling 61 when projected in the right-left direction. Thus, the power receiving portion 86 and the coupling 61 may be disposed at substantially the same vertical position, and the size of the developing cartridge 7 may be still smaller.

In addition, as shown in FIG. 3 and FIG. 4, regarding the developing cartridge 7, the drive power may be transferred from the coupling 61 to the new cartridge detection gear 82 using the agitator 15, which may decrease the number of parts used.

Certain configurations of the developing cartridge 7 now is described with reference to FIG. 15. Further, the members used in the configurations of FIG. 15 that may be the same as those disclosed above may be referenced with the same reference numbers. Accordingly, descriptions of such members are omitted below.

Similar to configurations described above, the end portion of the new cartridge detection gear 82 may be formed with a partial cylinder shape.

Figure 15:
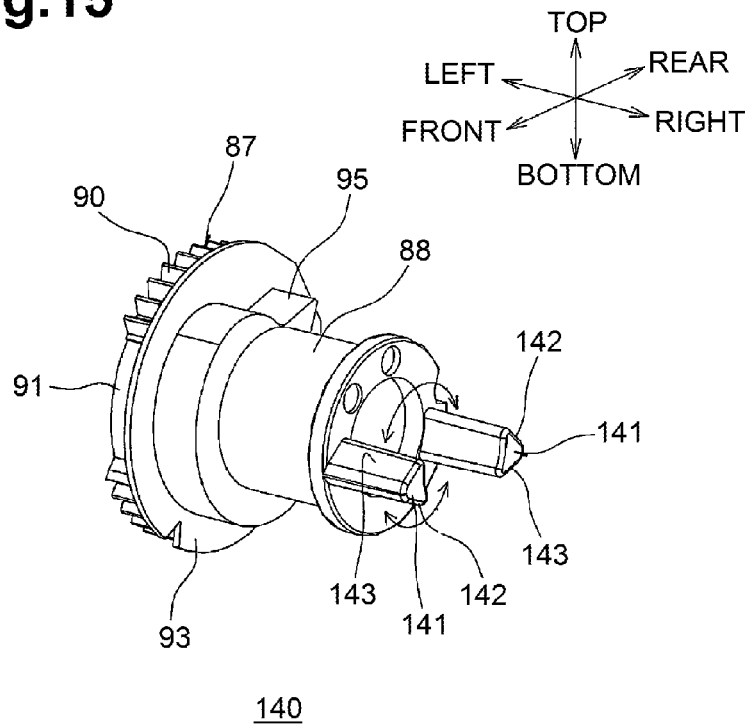
FIG. 15 is a diagram showing a perspective view of the new cartridge detection gear.

As shown in FIG. 15, an end portion 141 may form a substantially triangular prism shape extending from the right end of the cylinder portion 88 toward the right side.

A new cartridge detection gear 140 may comprise two end portions 141. One end portion 141 may be provided at each of the two ends in a radial direction of the cylinder portion 88. Specifically, in the left side view, one end portion 141 (e.g., a front side) may be disposed at the inner side in the radial direction of the downstream end portion of the teeth portion 90 in a clockwise direction. Further, in the right side view, another end portion 141 (e.g., rear side) may be disposed at the inner side in the radial direction near the center portion of the teeth portion 90 in the clockwise direction. Moreover, the downstream end surface of the end portion 141 in the clockwise direction in the right side view may comprise a downward slanting face 143 that may slant toward the outside in the radial direction following in an upstream clockwise direction in the right side view. In addition, the upstream end surface of the end portion 141 in a clockwise direction in the right side view may comprise an upward slanting face 142 that may slant toward the interior radial direction following in an upward clockwise direction from the right side view.

Similar to configurations described above, after the attaching the developing cartridge 7 to the casing 2 is complete, the developer side contact 119 of the swinging electrode 114 may contact the power receiving portion 86 of the developing cartridge 7 from the rear side through the space between each end portion 141. Further, the swinging electrode 114 may be disposed at the connected position, and the casing side contact 120 may contact the free end portion 115 of the fixed electrode 112. At this time, one end portion 141 may be disposed at the front side of the holder member 113 and the swinging electrode 114.

Thus, similar to the configurations described above, the CPU 133 may determine that the developer bias is applied to the fixed electrode 112.

Further, once the warm-up operation of the printer 1 is started and the new cartridge detection gear 82 is rotated clockwise from the right-view, one end portion 141 of the new cartridge detection gear 82 may abut with the electrode portion 118 of the swinging electrode 114 from the front side, and pressure may be applied to the electrode portion 118 of the swinging electrode 114 from the rear side. Consequently, the holder member 113 and the swinging electrode 114 may rise over one end portion 141 along the downward slanting face 143 on one end portion 89 against the elastic force of the swinging electrode 114 and may separate from the power receiving portion 86 of the developing cartridge 7 toward the rear side, such that the holder member 113 and the swinging electrode 114 may be disposed at the upper separated position.

Thus, the developer side contact 119 of the swinging electrode 114 may separate from the power receiving portion 86 of the developing cartridge 7 toward the rear side, and the electrical connection between the swinging electrode 114 and the power receiving portion 86 may be released. Further, the casing side contact 120 on the swinging electrode 114 may be separated from the free end portion 115 of the fixed electrode 112 toward the top side, and the electrical connection between the swinging electrode 114 and the fixed electrode 112 may be released. At this time, the CPU 133 may determine that the developer bias is not applied to the fixed electrode 112.

Moreover, when the new cartridge detection gear 82 is further rotated clockwise in the right side view, one end portion 141 of the new cartridge detection gear 82 may travel between the power receiving portion 86 and the holder member 113 from the upper-front side to the tower-rear side. Thus, the holder member 113 and the swinging electrode 114 may swing toward the front side due to the elastic force of the swinging electrode 114 and may tower from one end portion 141 along the downward slanting face 143 of one end portion 141, such that the holder member 113 and the swinging electrode 114 may return to being disposed at the connected position. Consequently, the CPU 133 may determine that the developer bias is applied to the fixed electrode 112. Thus, after the warm-up operation has started, the CPU 133 may determine that the developer bias has been applied to the fixed electrode 112, then that the developer bias is not applied to the 112, and then again that the developer bias has been applied to the fixed electrode 112 in this order.

Thereafter, when the new cartridge detection gear 82 is further rotated, in the same way as one end portion 141, the other end portion 141 may move the swinging electrode 114 from the connected position to the upper separated position and back to the connected position. Consequently, the CPU 133 again may determine that the developer bias has been applied to the fixed electrode 112, that the developer bias is not applied to the 112, and that the developer bias has again been applied to the fixed electrode 112, in this order.

Thereafter, when the new cartridge detection gear 82 is further rotated, the toothless portion 91 of the new cartridge detection gear 82 may align with the second agitator gear 66, the engagement between the teeth portion 90 of the new cartridge detection gear 82 and the second agitator gear 66 may be released, and the rotational drive of the new cartridge detection gear 82 may be stopped. Subsequently, the warm-up operation may be completed.

In certain configurations, an association may be made between the number of times that the CPU 133 determines that the developer bias is not applied to the fixed electrode 112 and the maximum number of image formations. For example, an association may be made so that, when the number of times that the CPU 133 determines that the developer bias is not applied to the fixed electrode 112 is two, this corresponds to a maximum number of image formations of 6000, and, when the number of times that the CPU 133 determines that the developer bias is not applied to the fixed electrode 112 is one, this corresponds to a maximum number of image formations of 3000.

Further, as previously described, after the warm-up operation has started, the CPU 133 may determine that the developer bias has been applied to the fixed electrode 112, that the developer bias is not applied to the fixed electrode 112, and that the developer bias has again been applied to the fixed electrode 112, in this order, such that, when the number of times of determining that the developer bias is not applied to the fixed electrode 112 is two, the maximum number of image formations for the developing cartridge 7 may be determined to be 6000.

The functional effects obtained from the certain configurations described above may be the same as or similar to those of the configurations described above.

A developing cartridge 150 according to particular configurations now is described with reference to FIG. 16 and FIG. 17. Further, the members used in particular configurations that are the same as or similar to those of the configurations described above may be referred to using the same reference numbers, and further descriptions of such members are omitted below.

According to the above-described configurations, the drive power input into the coupling 61 may be transferred to the new cartridge detection gear 82 through the agitator shaft 16.

Figure 16:
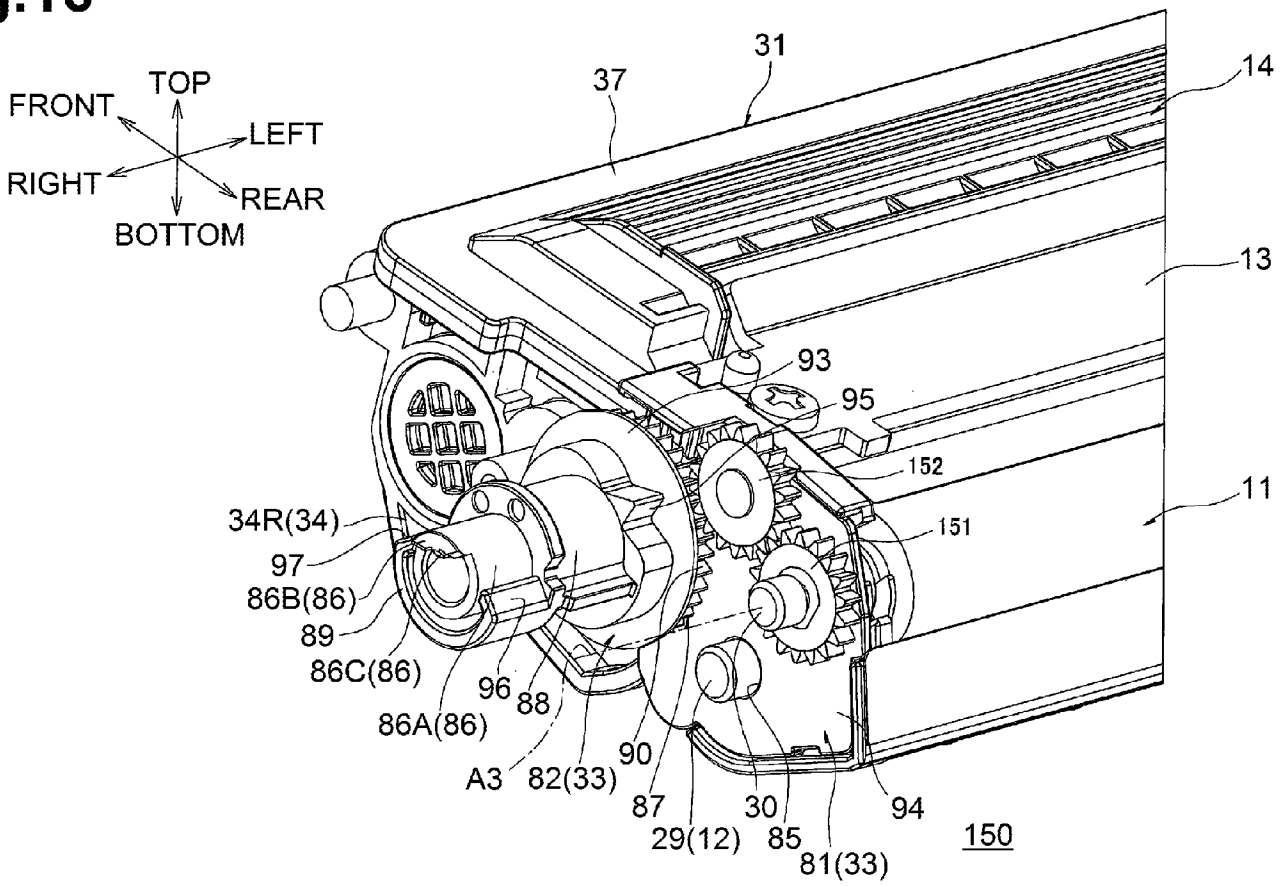
FIG. 16 is a diagram showing a perspective view of a power supply device for the developing cartridge.
Figure 17:
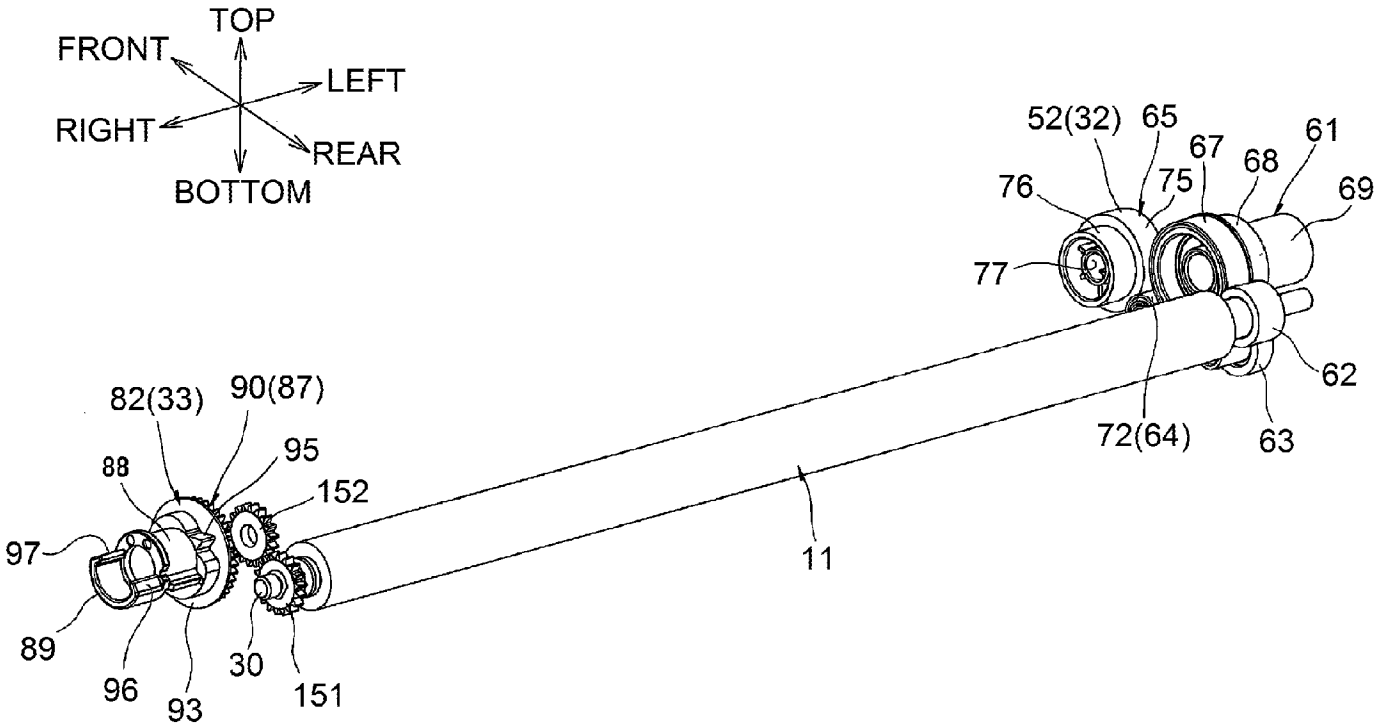
FIG. 17 is a diagram illustrating a process of drive transfer through the developing cartridge that shows a drive system for the developing cartridge.

In contrast, according to particular configurations shown in FIG. 16 and FIG. 17, the drive power input into the coupling 61 may be transferred to the new cartridge detection gear 82 through the developing roller 11, which may comprise the developing roller shaft 30. The developing roller 11 may rotate around a rotational axis A3 of the developing roller shaft 30 (shown in FIG. 16).

According to particular configurations, the second agitator gear 66 may not be provided on the right end portion of the agitator shaft 16. Further, the developing roller shaft supporting portion 84 may not be provided on the electrode member 81, and the right end portion of the developing roller shaft 30 may protrude from the right surface of the electrode member 81 toward the right side.

A first idle gear 151 may be supported on the right end portion of the developing roller shaft 30 to prevent relative rotation therebetween. Further, a second idle gear 152 may be rotatably supported on the right surface of the electrode member 81. The second idle gear 152 may engage with the first idle gear 151 from the upper-front side and, at the same time, may engage with the teeth portion 90 of the sector gear 87 of the new cartridge detection gear 82 from the upper-rear side.

Moreover, as shown in FIG. 17, when the warm-up operation starts, the drive power may be transferred from the coupling 61 to the developing gear 62, and the developing roller 11 may be rotated.

When the developing roller 11 is rotated, the developing roller shaft 30 and first idle gear 151 may be rotated, the drive power may be transferred to the teeth portion 90 of the sector gear 87 of the new cartridge detection gear 82 through the second idle gear 152, and the new cartridge detection gear 82 may be rotated clockwise in the right view.

In particular configurations, the drive power may be transferred from the coupling 61 to the new cartridge detection gear 82 using the developing roller 11. Accordingly, the number parts used may be decreased.

The functional effects obtained from particular configurations may be the same as or similar to those of the above-described configurations.

A developing cartridge 160 according to some configurations now is described with reference to FIG. 18 and FIG. 19. Further, the members used in some configurations that are the same as or similar to those of the first embodiment may be referred to using the same reference numbers. Further description of such members is omitted.

According to the configurations described above, the drive power input into the coupling 61 may be transferred to the new cartridge detection gear 82 through the agitator shaft 16.

Figure 18:
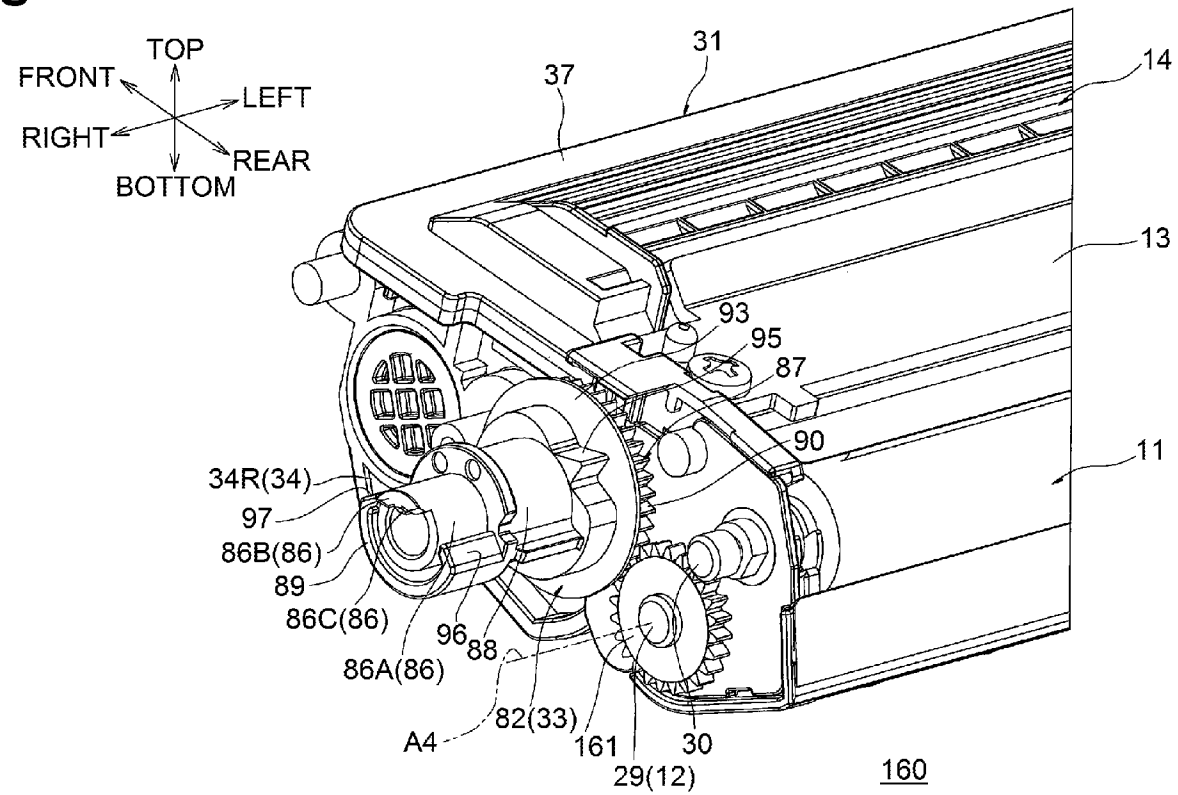
FIG. 18 is a diagram showing another perspective view of another power supply device for the developing cartridge.
Figure 19:
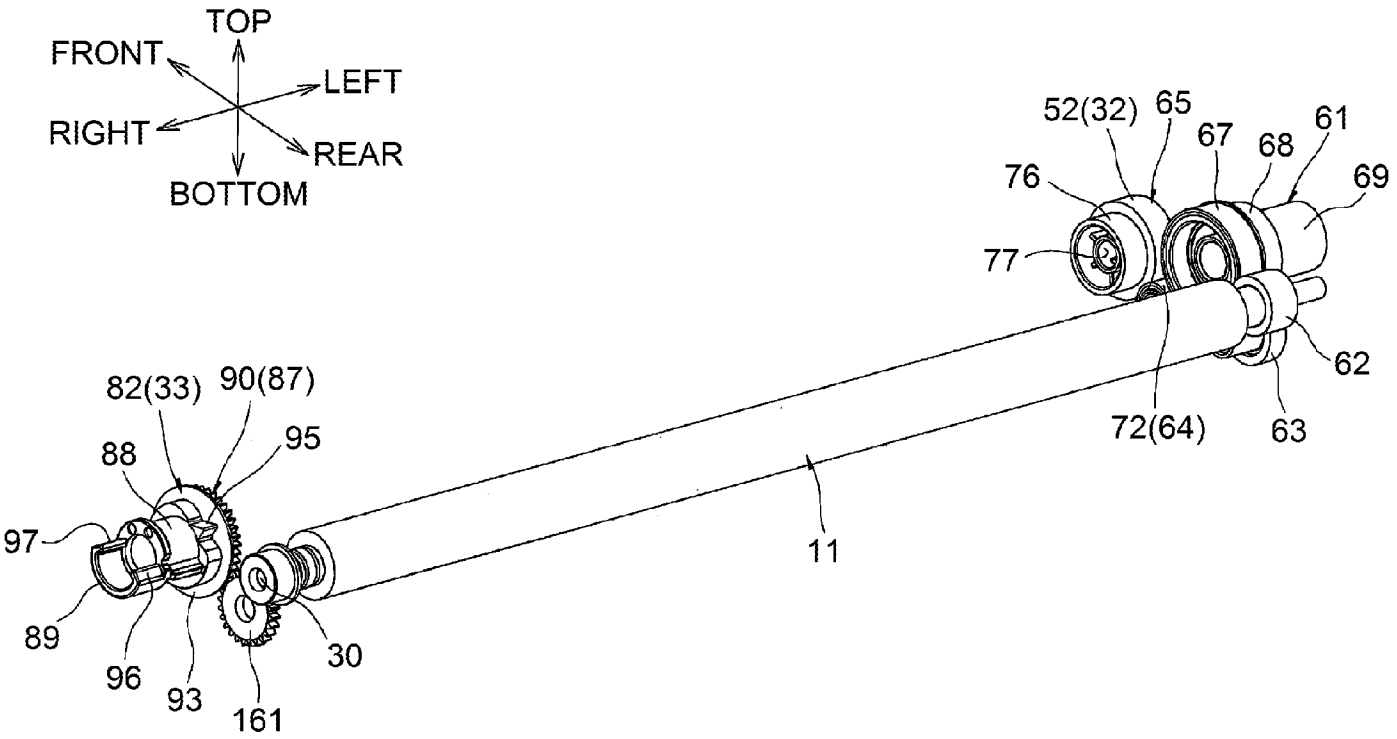
FIG. 19 is a diagram illustrating another process of drive transfer through the developing cartridge that shows another drive system for the developing cartridge.

In contrast, according to configurations shown in FIG. 18 and FIG. 19, the drive power input into the coupling 61 may be transferred to the new cartridge detection gear 82 through the supply roller 12. The supply roller 12 may rotate around a rotational axis A4 of the supply roller shaft 29 (shown in FIG. 18).

According to some configurations, the second agitator gear 66 may not be provided on the right end portion of the agitator shaft 16. Further, the right end portion of the supply roller shaft 29 may protrude from the left surface of the electrode member 81 toward the right side.

An idle gear 161 may be supported on the right end portion of the supply roller shaft 29 to prevent rotation. The idle gear 161 may engage with the teeth portion 90 of the sector gear 87 of the new cartridge detection gear 82 from the lower-rear side.

Further, as shown in FIG. 19, when the warm-up operation starts, the drive power may be transferred from the coupling 61 to the supply gear 63, and the supply roller 12 may be rotated.

When the supply roller 12 is rotated, the supply roller shaft 29 and the idle gear 161 may be rotated, the drive power may be transferred from the idle gear 161 to the teeth portion 90 of the sector gear 87 of the new cartridge detection gear 82, and the new cartridge detection gear 82 may be rotated clockwise in the right view.

Regarding some configurations, the drive power may be transferred from the coupling 61 to the new cartridge detection gear 82 using the supply roller 12, and the number of parts used may be reduced.

The functional effects obtained from some configurations may be the same as or similar to those of the configurations described above.

A developing cartridge 170 according to a further configurations now is described with reference to FIG. 20. Further, the members used in further configurations that are the same as or similar to those of the configurations described above may be referred to using the same reference numbers, and descriptions of such members are omitted.

According to the configurations described above, the idle gear 161 may be provided on the right end portion of the supply roller shaft 29, and the idle gear 161 may engage with the teeth portion 90 of the sector gear 87 of the new cartridge detection gear 82 from the lower-rear side.

Figure 20:
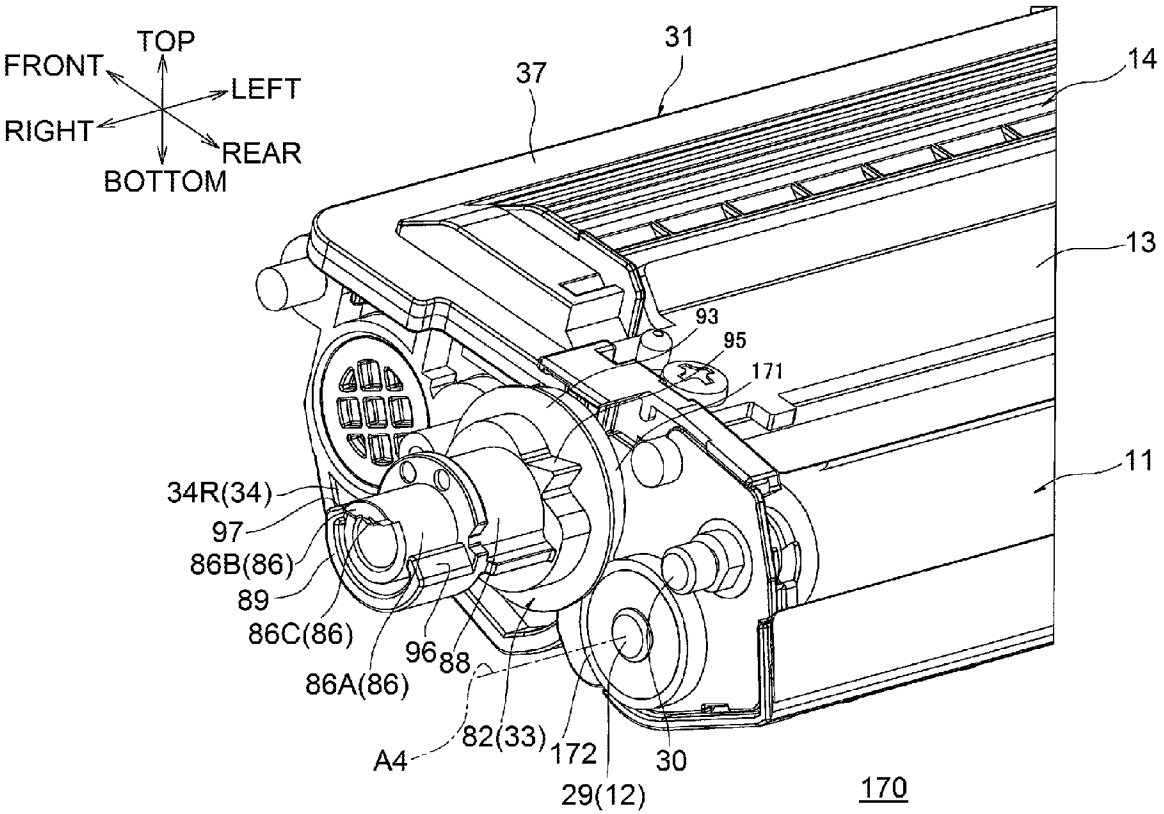
FIG. 20 is a diagram showing a perspective view of still another power supply device for the developing cartridge.

In contrast, according to further configurations shown in FIG. 20, a first resistance applying member 171 forming a substantially disc shape, in which at least the outer circumference may be formed of materials with a relatively high coefficient of friction, such as rubber, may be provided to the new cartridge detection gear in addition to the new cartridge detection gear 82. Further, a second resistance applying member 172 forming a substantially disc shape, in which at least the outer circumference may be formed of materials with a relatively high coefficient of friction, such as rubber, may be provided to the right end portion of the supply roller shaft 29 in addition to the idle gear 161 to contact the first resistance applying member 171 from the rear side.

When the warm-up operation starts, the supply roller 12 may be rotated in the same way as that in some configurations described above.

When the supply roller 12 is rotated, the supply roller shaft 29 and the second resistance applying member 172 may be rotated, the drive power may be transferred from second resistance applying member 172 to the first resistance applying member 171 by the friction power between the second resistance applying member 172 and the first resistance applying member 171, and the new cartridge detection gear 82 may be rotated clockwise in the right view.

The functional effects obtained from further configurations may be the same as or similar to those of the configurations described above.

A developing cartridge 180 according to still further configurations now is described with reference to FIG. 21 and FIG. 22. Further, the members used in still further configurations that are the same as or similar to those of the above-described configurations may be referred to using the same reference numbers, and descriptions of such members are omitted.

According to the configurations described above, the drive power input into the coupling 61 may be transferred to the new cartridge detection gear 82 through the agitator shaft 16.

Figure 21:
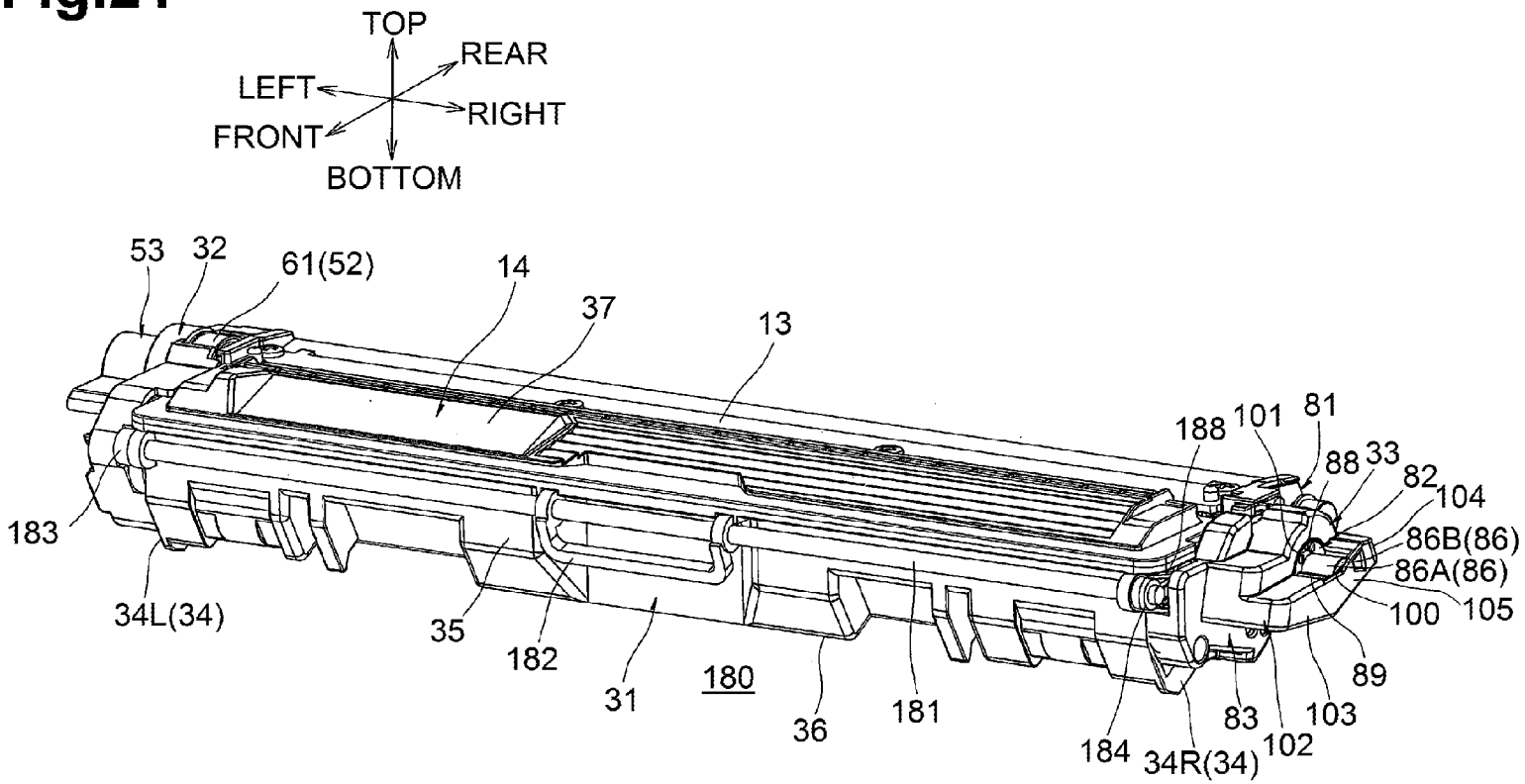
FIG. 21 is a diagram illustrating still another process of drive transfer through the developing cartridge that shows still another drive system for the developing cartridge.
Figure 23:
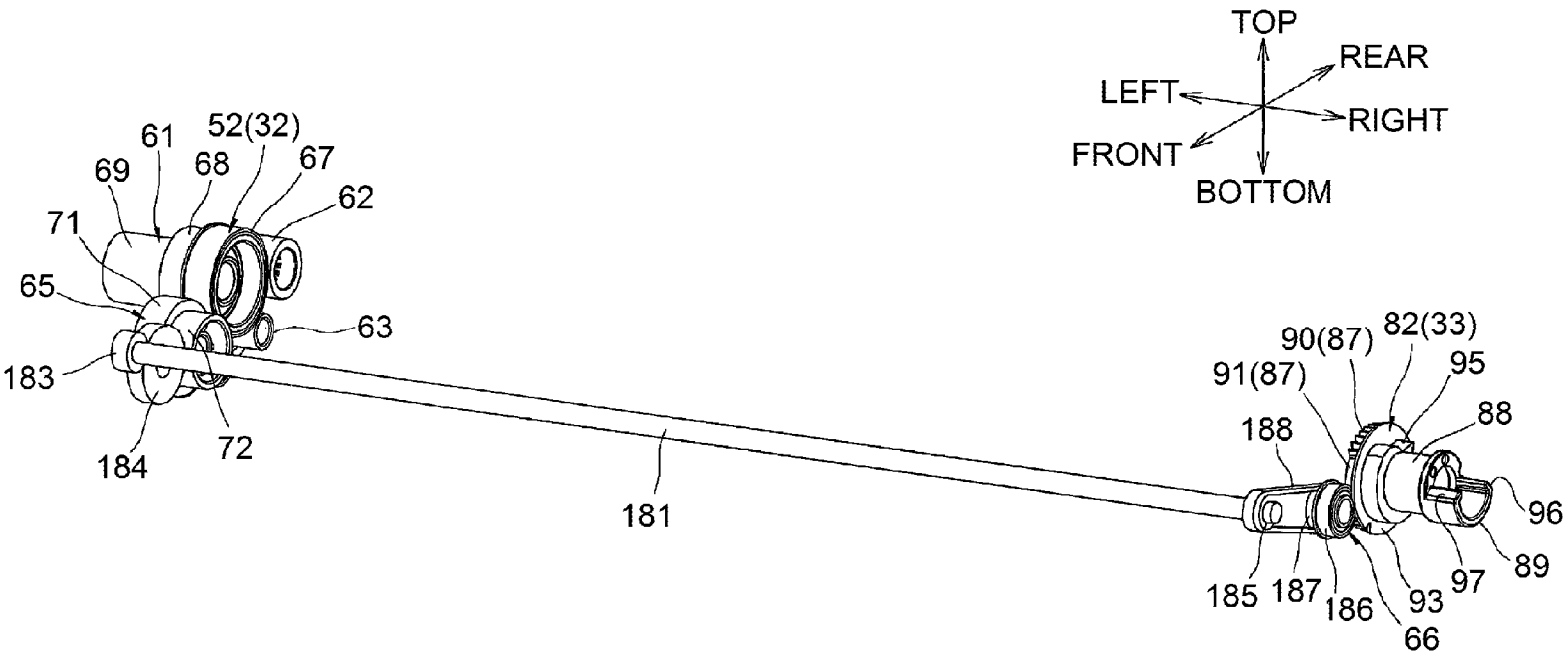
FIG. 23 is a diagram illustrating yet another process of drive transfer through the developing cartridge.

In contrast, according to still further configurations shown in FIG. 21 and FIG. 23, the drive power input into the coupling 61 may be transferred to the new cartridge detection gear 82 through an external rotational shaft 181 supported at the front side of the cartridge frame 31.

The external rotational shaft 181 may form a substantially cylindrical shape extending in the right-left direction, and the right and left end portions thereof may be rotatably supported at the front end portion of the cartridge frame 31. The external rotational shaft 181 may be rotated around a rotational axis A5 (shown in FIG. 22). Further, a handle 182, which may be grasped, may be rotatably supported near the right-left center of the external rotational shaft 181.

An input gear 183 to input the drive power to the external rotational shaft 181 may be supported on the left end portion of the external rotational shaft 181 to prevent relative rotation therebetween. An idle gear 184 may be disposed between the input gear 183 and the first agitator gear 65. Further, a pulley 185 may be supported on the right end portion of the external rotational shaft 181 to prevent relative rotation therebetween.

Figure 22:
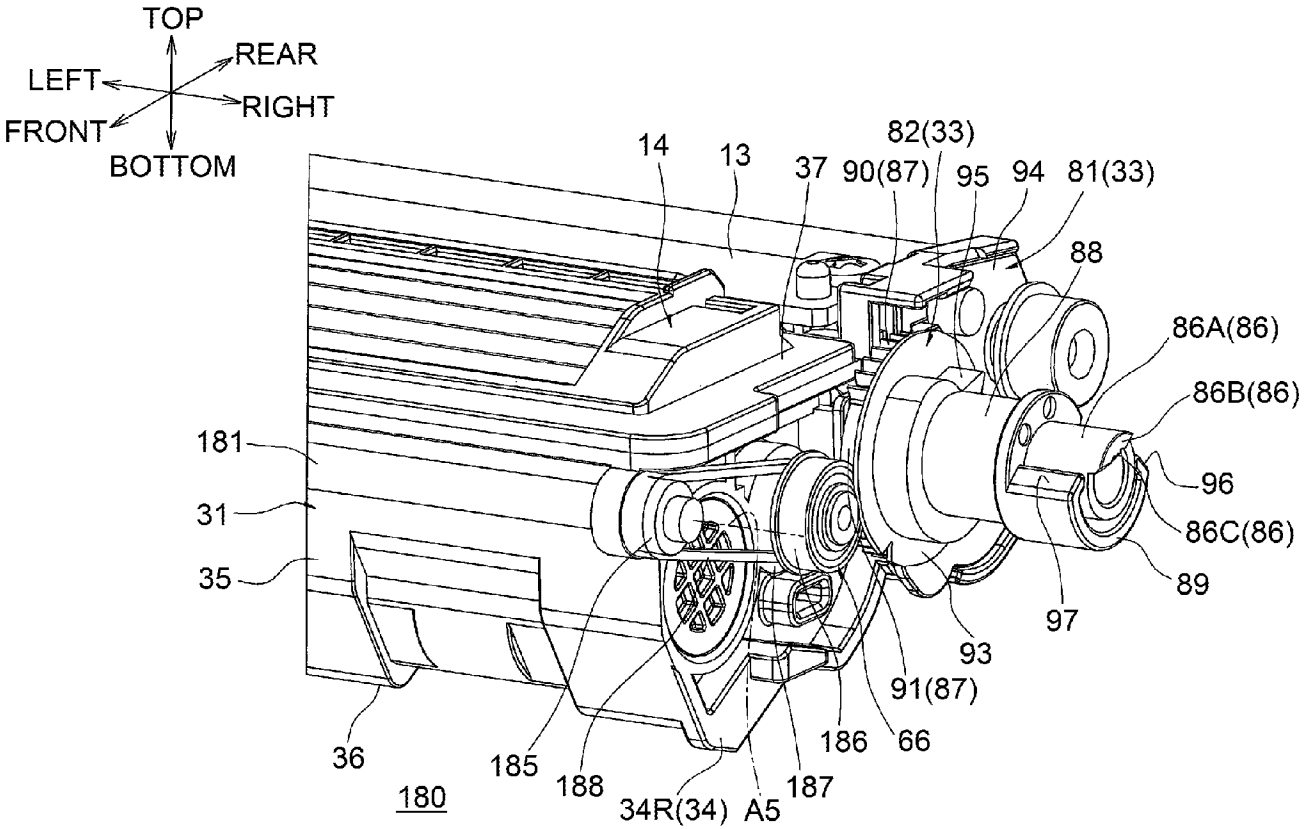
FIG. 22 is a diagram showing a perspective view of yet another power supply device shown in the still another drive system in FIG. 21.

As shown in FIG. 22, the second agitator gear 66 may comprise a gear portion 186 and a pulley portion 187 in an integrated manner.

The gear portion 186 may be provided at the right end portion of the second agitator gear 66, and may engage with the teeth portion 90 of the sector gear 87 of the new cartridge detection gear 82 from the front side.

The pulley portion 187 may be provided at the left end portion of the second agitator gear 66. Further, the pulley portion 187 may not comprise gear teeth.

Further, the second agitator gear 66 may be rotatably supported by the agitator shaft 16. Thus, the drive power may not be transferred from the agitator shaft 16 to the second agitator gear 66.

In addition, an endless belt 188 may be wrapped around the pulley portion 187 of the second agitator gear 66 and the pulley portion 185 of the external rotational shaft 181.

When the warm-up operation starts, as shown in FIG. 23, the drive power may be transferred from the coupling 61 to the first agitator gear 65 in the same way or a similar way as in the configurations described above, and, afterwards, the drive power may be transferred to the external rotational shaft 181 through the idle gear 184 and the input gear 183, such that the external rotational shaft 181 may be rotated.

When the external rotational shaft 181 is rotated, the external rotational shaft 181 and the pulley 185 may be rotated, and the endless belt 188 may circle around. Thus, the drive power may be transferred to the pulley portion 187 of the second agitator gear 66 through the endless belt 188, the drive power may be transferred from the gear portion 186 of the second agitator gear 66 to the teeth portion 90 of the sector gear 87 of the new cartridge detection gear 82, and the new cartridge detection gear 82 may be rotated clockwise in the right view.

The functional effects obtained from still further configurations may be the same as those of the configurations described above.

While the invention has been described in connection with various exemplary structures and illustrative configurations, it will be understood by those skilled in the art that other variations and modifications of the structures, configurations, and embodiments disclosed above may be made without departing from the scope of the invention. For example, this application comprises each and every possible combination of the various elements and features disclosed and incorporated by reference herein, and the particular elements and features presented in the claims and disclosed and incorporated by reference above may be combined with each other in each and every possible way within the scope of the application, such that the application should be recognized as also directed to other embodiments comprising other possible combinations. Other structures, configurations, and embodiments consistent with the scope of the claimed invention will be apparent to those skilled in the art from a consideration of the specification or practice of the invention disclosed herein. It is intended that the specification and the described examples are illustrative with the true scope of the invention being defined by the following claims.

What is claimed is:

1. A cartridge comprising:

a developing roller configured to rotate about a first axis extending along a first direction;

an electrode configured to electrically connect to the developing roller, the electrode comprising:

a main body; and a protrusion protruding along the first direction from the main body to an end portion of the protrusion;

a detection member that is rotatably supported on the protrusion, the detection member comprising a cover portion configured to cover an exposable portion of the protrusion when the detection member is in a first rotational position and to expose the exposable portion of the protrusion when the detection member is in a second rotational position; and a cover member configured to cover a portion of the detection member, the cover member forming an opening therein that is configured to expose the cover portion of the detection member when the detection member is in the first rotational position, and the cover member extending along the first direction to an end portion of the cover member, wherein an overlap portion of the end portion of the protrusion extends at least to the end portion of the cover member, such that the overlap portion overlaps a portion of the end portion of the cover member in a second direction that is perpendicular to the first direction.

2. The cartridge according to claim 1, wherein the cover portion extends in the first direction to an end face of the cover portion, and wherein the overlap portion extends to a position farther from the main body in the first direction than a position of the end face of the cover portion.

3. The cartridge according to claim 2, wherein the cover member is configured to limit deformation of the overlap portion in the second direction to a particular amount of deformation.

4. The cartridge according to claim 1, wherein the cover portion extends in the first direction to an end face of the cover portion, and wherein the cover member is configured to cover the end face of the cover portion when the detection member is in the second rotational position.

5. The cartridge according to claim 1, wherein another portion of the end portion of the protrusion, which is different from the overlap portion, comprises an end face, and wherein the cover member covers the end face.

6. The cartridge according to claim 5, wherein the cover member comprises a fit portion that fits with the other portion of the end portion of the protrusion, which is different from the overlap portion.

7. The cartridge according to claim 6, wherein the protrusion of the electrode comprises a substantially tubular shape, and wherein the fit portion is disposed inside the protrusion.

8. The cartridge according to claim 6, further comprising a casing comprising:

an accommodation portion configured to accommodate developer, and another protrusion protruding in the first direction, wherein the protrusion forms a hole into which the projection of the casing fits.

9. The cartridge according to claim 1, wherein a remaining portion of the end portion of the protrusion other than the overlap portion, comprises an end face, and wherein the cover member covers the end face.

10. The cartridge according to claim 1, wherein the overlap portion comprises a substantially arc-shaped cross-section in a plane normal to the first direction.

11. The cartridge according to claim 1, wherein the overlap portion comprises a substantially arc-shaped cross-section in a plane normal to the first direction, and wherein another portion of the end portion of the protrusion, which is closer to the main body than and different from the overlap portion, comprises a substantially elliptical-shaped cross section in another plane normal to the first direction.

12. The cartridge according to claim 1, wherein the end portion of the cover member comprises:

an end face opposite to a main body side of the cover member; and an interior face that is substantially perpendicular to the first direction, disposed closer to the main body than the end face, and substantially aligned with the protrusion in the first direction, wherein the exposable portion of the protrusion is substantially aligned in the first direction with the overlap portion, and wherein the overlap portion extends to at least the interior face.

13. The cartridge according to claim 1, wherein the overlap portion contacts the portion of the end portion of the cover member that the overlap portion overlaps in the second direction.

14. The cartridge according to claim 1, wherein the detection member is configured to:

move from the first rotational position to the second rotational position, the protrusion configured to contact an electrical interface of a printer through the exposable portion when the detection member is in the second rotational position, the cover portion configured to be disposed between the protrusion and the electrical interface when the detection member is in the first rotational position, and move from the first rotational position to a third rotational position, in which the protrusion is configured to contact the electrical interface through the exposable portion.

15. The cartridge according to claim 1, wherein a dimension of the cover portion along a rotational direction of the detection member corresponds to information about the cartridge.

16. The cartridge according to claim 1, wherein the cover portion is configured to overlap with the protrusion in the second direction.

17. The cartridge according to claim 1, wherein the detection member comprises a sector gear.

18. The cartridge according to claim 1, wherein the electrode comprises a supporter that supports the developing roller rotatably.

19. The cartridge according to claim 1, further comprising:

a rotating member configured to rotate around a second axis;

a casing forming a developer accommodation space comprising:

a first wall, and a second wall separated from the first wall in the first direction, the rotating member disposed between the first wall and the second wall; and a coupling member, which is disposed on a side of the first wall that is opposite to the developer accommodation space, configured to receive a driving force, wherein the detection member, which is disposed on a side of the second wall that is opposite to the developer accommodation space, is configured to receive the driving force from the rotating member.

20. The cartridge according to claim 19, further comprising:

a first transmitting member, which is disposed on the side of the first wall that is opposite to the developer accommodation space, configured to rotate around the second axis and to transmit the driving force from the coupling member to the rotating member; and a second transmitting member, which is disposed on the side of the second wall that is opposite to the developer accommodation space, configured to rotate around the second axis and to transmit the driving force from the rotating member to the detection member.

21. The cartridge according to claim 20, wherein the first transmitting member comprises a first gear, the second transmitting member comprises a second gear, and a number of teeth of the first gear is different from a number of teeth of the second gear.

22. The cartridge according to claim 21, wherein the number of teeth of the first gear is greater than the number of the teeth of the second gear.

23. The cartridge according to claim 19, wherein the detection member overlaps with the coupling member in the first direction.

24. The cartridge according to claim 19, wherein the protrusion overlaps with the coupling member in the first direction.

25. The cartridge according to claim 19, wherein the rotating member is an agitator configured to agitate developer.

26. A cartridge comprising:

a developing roller configured to rotate about a first axis extending along a first direction;

an electrode configured to electrically connect to the developing roller, the electrode comprising:

a main body; and a protrusion protruding along the first direction from the main body to an end portion of the protrusion;

a detection member that is rotatably supported on the protrusion, the detection member comprising a cover portion that covers a portion of the protrusion and that exposes another portion of the protrusion; and a cover member forming an opening that exposes the cover portion of the detection member, the cover member covering another portion of the detection member, and the cover member extending along the first direction to an end portion of the cover member, wherein an overlap portion of the end portion of the protrusion extends at least to the end portion of the cover member, such that the overlap portion overlaps a portion of the end portion of the cover member in a second direction that is perpendicular to the first direction.

27. A cartridge comprising:

a developing roller configured to rotate about a first axis extending along a first direction;

an electrode configured to electrically connect to the developing roller, the electrode comprising:

a main body; and a protrusion protruding along the first direction from the main body to an end portion of the protrusion;

a detection member that is rotatably supported on the protrusion, the detection member comprising a cover portion that covers a portion of the protrusion and that exposes another portion of the protrusion; and a cover member forming an opening that exposes the other portion of the protrusion, the cover member covering at least a portion of the cover portion, and the cover member extending along the first direction to an end portion of the cover member, wherein an overlap portion of the end portion of the protrusion extends at least to the end portion of the cover member, such that the overlap portion overlaps a portion of the end portion of the cover member in a second direction that is perpendicular to the first direction.

28. A cartridge comprising:

a developing roller configured to rotate about a first axis;

an electrode comprising:

a first base portion, and a first protrusion extending from the first base portion in a first direction parallel to the first axis of the developing roller and comprising a first portion and a second portion, the second portion of the first protrusion disposed between the first base portion of the electrode and the first portion of the first protrusion;

a detection member comprising:

a second base portion rotatably supported at the second portion of the first protrusion and configured to rotate about a second axis, and at least one second protrusion extending from the second base portion along the first portion of the first protrusion in the first direction; and a frame forming an opening, the opening defined in a frame surface ex ding in the first direction, wherein an outer surface of the first portion of the first protrusion comprises:

a third portion comprising an entire portion of the outer surface between the second axis and the at least one second protrusion; and a fourth portion that is another portion of the outer surface of the protrusion; and a fifth portion outside the frame and beyond the frame surface, and wherein an overlap portion of the first portion of the first protrusion extends at least to an end portion of the frame in the first direction, such that the overlap portion overlaps a portion of the end portion of the frame in a second direction that is perpendicular to the first direction.

* * * * *